US012064671B2

(12) United States Patent
Taylor

(10) Patent No.: US 12,064,671 B2
(45) Date of Patent: Aug. 20, 2024

(54) PROPELLENT-DRIVEN GOLF CLUB TO PROPEL A BALL WITHOUT REQUIRING A SWINGING ACTION ON THE PROPELLENT-DRIVEN GOLF CLUB

(71) Applicant: Roy H. Taylor, Byhalia, MS (US)

(72) Inventor: Roy H. Taylor, Byhalia, MS (US)

( * ) Notice: Subject to any disclaimer, the term of this patent is extended or adjusted under 35 U.S.C. 154(b) by 0 days.

(21) Appl. No.: 18/486,943

(22) Filed: Oct. 13, 2023

(65) Prior Publication Data

US 2024/0033592 A1 Feb. 1, 2024

Related U.S. Application Data

(63) Continuation-in-part of application No. 17/300,199, filed on Apr. 12, 2021, now abandoned.

(51) Int. Cl.

| | |
|---|---|
| ***A63B 53/04*** | (2015.01) |
| ***A63B 53/08*** | (2015.01) |
| ***A63B 53/14*** | (2015.01) |
| ***A63B 60/00*** | (2015.01) |
| *A63B 71/06* | (2006.01) |

(52) U.S. Cl.

CPC ..... *A63B 53/08* (2013.01); *A63B 53/14* (2013.01); *A63B 60/002* (2020.08); *A63B 2071/0694* (2013.01); *A63B 2209/00* (2013.01)

(58) Field of Classification Search

CPC ..... A63B 53/04; A63B 2053/0495
USPC ..... 473/324–350
See application file for complete search history.

(56) References Cited

U.S. PATENT DOCUMENTS

| | | | | | |
|---|---|---|---|---|---|
| 1,336,671 | A * | 4/1920 | Backus | A63B 53/0466 | 473/327 |
| 4,170,357 | A * | 10/1979 | Greer | A63B 53/04 | 473/324 |
| 5,522,594 | A * | 6/1996 | Taylor | A63B 53/04 | 473/282 |
| 5,529,303 | A * | 6/1996 | Chen | A63B 53/04 | 473/327 |
| 5,681,227 | A * | 10/1997 | Sayrizi | A63B 60/00 | 473/350 |
| 5,807,187 | A * | 9/1998 | Hamm | A63B 60/00 | 473/345 |

(Continued)

FOREIGN PATENT DOCUMENTS

| | | | | |
|---|---|---|---|---|
| IT | 1159725 B | * | 3/1987 | A01K 87/06 |
| WO | 1998020944 A1 | | 5/1998 | |

*Primary Examiner* — Alvin A Hunter

(57) ABSTRACT

Disclosed herein is a propellent-driven golf club to propel a ball without requiring a swinging action. Accordingly, the propellent-driven golf club may include a hollow shaft, a handle attached to a top portion of the hollow shaft, and a golf club head assembly attached to a bottom portion of the hollow shaft. Further, the golf club head assembly may include a bar receptacle comprising receptacles configured to receive cartridges, the firing mechanism operationally coupled to the triggering device, a firing cylinder port configured to receive at least a portion of a cartridge, a vortex generator comprising a chamber that may include an ingress port and an egress port, a range control mechanism comprising a range control valve fluidly coupled to the egress port of the chamber, a firing cylinder bore fluidly coupled to an outlet of the range control valve, and a piston movably disposed in the firing cylinder bore.

19 Claims, 28 Drawing Sheets

(56) References Cited

U.S. PATENT DOCUMENTS 5,816,927 A * 10/1998 Taylor ..... A63B 60/00 473/282
5,860,869 A * 1/1999 Duncalf ..... A63B 53/04 473/282
5,908,357 A * 6/1999 Hsieh ..... A63B 53/0466 473/346
5,924,932 A * 7/1999 Taylor ..... A63B 60/00 473/282
5,971,864 A * 10/1999 Joshi ..... A63B 53/00 473/226
6,139,440 A * 10/2000 Taylor ..... A63B 53/04 473/282
6,835,142 B1 * 12/2004 Levosinski ..... A63B 60/00 473/282
7,070,514 B1 * 7/2006 Borunda ..... A63B 60/00 473/333
8,579,721 B1 * 11/2013 Taylor ..... A63B 65/122 473/282
8,651,973 B2 * 2/2014 Okot ..... A63B 53/10 473/317
8,900,065 B2 * 12/2014 Taylor ..... A63B 53/08 473/282
9,889,347 B2 * 2/2018 Morales ..... A63B 53/0466
10,065,082 B2 * 9/2018 James ..... A63B 53/0466
2004/0009829 A1 * 1/2004 Kapilow ..... A63B 60/00 473/345
2004/0127301 A1 * 7/2004 Lee ..... A63B 53/0466 473/282
2005/0037862 A1 * 2/2005 Hagood ..... A63B 60/42 473/345
2005/0124435 A1 * 6/2005 Gambetta ..... A63B 53/0466 473/327
2007/0293341 A1 * 12/2007 Jeong ..... A63B 60/006 473/327
2008/0280692 A1 * 11/2008 Cage ..... A63B 53/08 473/409
2009/0029793 A1 * 1/2009 Cage ..... A63B 53/04 73/489
2011/0081980 A1 * 4/2011 Cage ..... G01S 15/88 473/409
2013/0252753 A1 * 9/2013 Taylor ..... A63B 65/122 473/282
2016/0074720 A1 * 3/2016 Kline ..... A63B 53/06 473/250
2022/0105395 A1 * 4/2022 Sada, Jr. ..... A63B 60/50

* cited by examiner

PROPELLENT-DRIVEN GOLF CLUB TO PROPEL A BALL WITHOUT REQUIRING A SWINGING ACTION ON THE PROPELLENT-DRIVEN GOLF CLUB

The current application is a continuation-in-part (CIP) application of the U.S. non-provisional application Ser. No. 17/300,199 filed on Apr. 12, 2021.

FIELD OF THE INVENTION

Generally, the present disclosure relates to the field of golf clubs. More specifically, the present disclosure relates to a propellent-driven golf club to propel a ball without requiring a swinging action on the propellent-driven golf club.

BACKGROUND OF THE INVENTION

The field of golf clubs is technologically important to several industries, business organizations and/or individuals. In particular, the use of golf clubs is prevalent for propelling a ball without requiring a swinging action on a golf club.

The recreational sport played on a golf course utilizes many types of golf clubs with varying face angles. Generally, golf clubs are swung in an arc starting above the user's head. This creates a club face velocity that imparts kinetic energy to the ball positioned on the ground or a tee. A shorter arc traveled by the club results in the transfer of less kinetic energy thereby varying the distance the ball travels. A key element of playing the game requires' controlling the precise direction and distance the ball travels along the course of play. Many users find playing the game of golf extremely challenging or unable to participate.

Therefore, there is a need for improved golf clubs that may overcome one or more of the above-mentioned problems and/or limitations.

SUMMARY OF THE INVENTION

This summary is provided to introduce a selection of concepts in a simplified form, that are further described below in the Detailed Description. This summary is not intended to identify key features or essential features of the claimed subject matter. Nor is this summary intended to be used to limit the claimed subject matter's scope.

Disclosed herein is a propellent-driven golf club to propel a ball without requiring a swinging action on the propellent-driven golf club, in accordance with some embodiments. Accordingly, the propellent-driven golf club may include a hollow shaft. Further, the propellent-driven golf club may include a handle attached to a top portion of the hollow shaft. Further, the handle may include a triggering device configured for actuating a firing mechanism. Further, the propellent-driven golf club may include a golf club head assembly attached to a bottom portion of the hollow shaft. Further, the golf club head assembly may include a bar receptacle that may include a plurality of receptacles configured to receive a plurality of cartridges. Further, the golf club head assembly may include the firing mechanism operationally coupled to the triggering device. Further, the firing mechanism may be configured for firing a cartridge of the plurality of cartridges upon the actuating. Further, firing the cartridge generates gases. Further, the golf club head assembly may include a firing cylinder port configured to mate with at least a portion of the cartridge. Further, the golf club head assembly may include a vortex generator comprising a chamber that may include an ingress port and an egress port. Further, the ingress port may be fluidly coupled to the firing cylinder port in order to receive the gases. Further, an interior profile of the chamber may be deflected to enhance gas resonation. Further, the golf club head assembly may include a range control mechanism comprising a range control valve fluidly coupled to the egress port of the chamber. Further, the range control valve may be configured to control a pressure of the gases at an outlet of the range control valve. Further, the golf club head assembly may include a firing cylinder bore fluidly coupled to the outlet of the range control valve. Further, the golf club head assembly may include a piston movably disposed in the firing cylinder bore. Further, the gases drive the piston. Further, a free end of the piston may be configured to strike the ball.

Further disclosed herein is a propellent-driven golf club to propel a ball without requiring a swinging action on the propellent-driven golf club, in accordance with some embodiments. Accordingly, the propellent-driven golf club may include a hollow shaft. Further, the propellent-driven golf club may include a handle attached to a top portion of the hollow shaft. Further, the handle may include a triggering device configured for actuating a firing mechanism. Further, the propellent-driven golf club may include a golf club head assembly attached to a bottom portion of the hollow shaft. Further, the golf club head assembly may include a bar receptacle that may include a plurality of receptacles configured to receive a plurality of cartridges. Further, the golf club head assembly may include the firing mechanism operationally coupled to the triggering device. Further, the firing mechanism may be configured for firing a cartridge of the plurality of cartridges upon the actuating. Further, firing the cartridge generates gases. Further, the golf club head assembly may include a firing cylinder port configured to mate with at least a portion of the cartridge. Further, the golf club head assembly may include a vortex generator comprising a chamber that may include an ingress port and an egress port. Further, the ingress port may be fluidly coupled to the firing cylinder port in order to receive the gases. Further, an interior profile of the chamber may be deflected to enhance gas resonation. Further, the golf club head assembly may include a range control mechanism comprising a range control valve fluidly coupled to the egress port of the chamber. Further, the range control valve may be configured to control a pressure of the gases at an outlet of the range control valve. Further, the golf club head assembly may include a firing cylinder bore fluidly coupled to the outlet of the range control valve. Further, the golf club head assembly may include a piston movably disposed in the firing cylinder bore. Further, the gases drive the piston. Further, a free end of the piston may be configured to strike the ball. Further, the propellent-driven golf club may include an anti-skid mechanism disposed on a bottom surface of the golf club head assembly. Further, the anti-skid mechanism may include a cleat plate comprising a plurality of cleats. Further, the plurality of cleats provides frictional force between the bottom surface and an external surface. Further, the propellent-driven golf club may be disposed on the external surface. Further, the frictional force resists a recoil motion imparted to the propellent-driven golf club based on the firing of the cartridge.

Further disclosed herein is a propellent-driven golf club to propel a ball without requiring a swinging action on the propellent-driven golf club, in accordance with some embodiments. Accordingly, the propellent-driven golf club may include a hollow shaft. Further, the propellent-driven golf club may include a handle attached to a top portion of the hollow shaft. Further, the handle may include a triggering device configured for actuating a firing mechanism. Further, the propellent-driven golf club may include a golf club head assembly attached to a bottom portion of the hollow shaft. Further, the golf club head assembly may include a bar receptacle that may include a plurality of receptacles configured to receive a plurality of cartridges. Further, the golf club head assembly may include the firing mechanism operationally coupled to the triggering device. Further, the firing mechanism may be configured for firing a cartridge of the plurality of cartridges upon the actuating. Further, firing the cartridge generates gases. Further, the golf club head assembly may include a firing cylinder port configured to receive at least a portion of the cartridge. Further, the golf club head assembly may include a vortex generator comprising a chamber that may include an ingress port and an egress port. Further, the ingress port may be fluidly coupled to the firing cylinder port in order to receive the gases. Further, an interior profile of the chamber may be deflected to enhance gas resonation. Further, the golf club head assembly may include a range control mechanism may include a range control valve fluidly coupled to the egress port of the chamber. Further, the range control valve may be configured to control a pressure of the gases at an outlet of the range control valve. Further, the golf club head assembly may include a firing cylinder bore fluidly coupled to the outlet of the range control valve. Further, the golf club head assembly may include a piston movably disposed in the firing cylinder bore. Further, the gases drive the piston. Further, a free end of the piston may be configured to strike the ball. Further, the golf club head assembly may include a bar disposition mechanism. Further, the bar receptacle may be disposed on the bar disposition mechanism. Further, the bar disposition mechanism may be moveable based on a pressing action performed by a user to facilitate reloading of the propellent-driven golf club. Further, the reloading of the propellent-driven golf club may include advancing of a second cartridge of the plurality of cartridges to a firing position upon firing of the cartridge. Further, the firing mechanism may be configured for firing the second cartridge in the firing position. Further, the propellent-driven golf club may include an anti-skid mechanism disposed on a bottom surface of the golf club head assembly. Further, the anti-skid mechanism may include a cleat plate comprising a plurality of cleats. Further, the plurality of cleats provides frictional force between the bottom surface and an external surface. Further, the propellent-driven golf club may be disposed on the external surface. Further, the frictional force resists a recoil motion imparted to the propellent-driven golf club based on the firing of the cartridge.

Both the foregoing summary and the following detailed description provide examples and are explanatory only. Accordingly, the foregoing summary and the following detailed description should not be considered to be restrictive. Further, features or variations may be provided in addition to those set forth herein. For example, embodiments may be directed to various feature combinations and sub-combinations described in the detailed description.

BRIEF DESCRIPTION OF THE DRAWINGS

The accompanying drawings, which are incorporated in and constitute a part of this disclosure, illustrate various embodiments of the present disclosure. The drawings contain representations of various trademarks and copyrights owned by the Applicant. All rights to various trademarks and copyrights represented herein are vested in and the property of the applicant. The Applicant retains and reserves all rights to the trademarks and copyrights included herein and has been assigned to grant permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure.

DETAILED DESCRIPTION OF THE INVENTION

Figure 1:
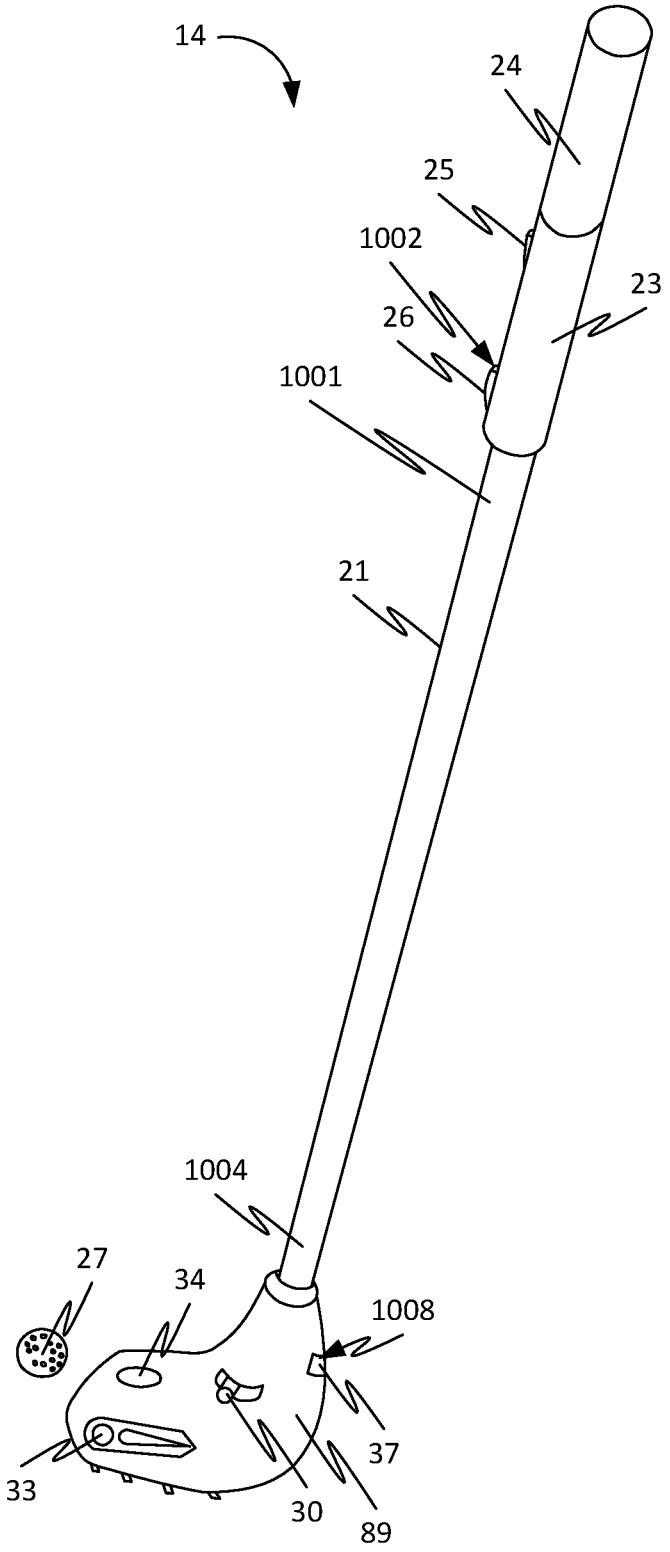
FIG. 1 is a front perspective view of a propellent-driven golf club 14 to propel a ball without requiring a swinging action on the propellent-driven golf club 14, in accordance with some embodiments.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim limitation found herein and/or issuing here from that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present disclosure. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the claims found herein and/or issuing here from. The present disclosure contains headers. It should be understood that these headers are used as references and are not to be construed as limiting upon the subjected matter disclosed under the header.

The present disclosure includes many aspects and features. Moreover, while many aspects and features relate to, and are described in the context of a propellent-driven golf club to propel a ball without requiring a swinging action on the propellent-driven golf club, embodiments of the present disclosure are not limited to use only in this context.

Overview

The present disclosure describes a propellent drive golf club to propel a ball without requiring a swinging action on the propellent driven golf club. Further, the propellent-driven golf club may be designed to be die cast as opposed to conventional investment cast, which contains a handle grip (or handle) consisting of a hollow shaft attached to a golf club head assembly designed to propel a golf ball from a static position, without swinging the club. The handle may include a triggering device that releases a spring-loaded firing pin cartridge lock down assembly designed to assemble into a hozzle of a golf club head of the golf club. Firing the golf club may be enabled by a safety release button. The golf club head may include a high stressed cylinder, mounted inside a hollow area of the die casted golf club head. Further, a hollow area of the hollow shaft creates a silencing chamber. Further, the golf club may include a bar receptacle, mounted across the aft end of a cylinder and through the golf club, that contains multi-firing ports designed to receive multi-cartridges contained in a plastic strip.

When the triggering device is actuated, the firing pin strikes one of a series of gun powder filled blank cartridges contained in the bar receptacle thereby firing the cartridge. The fired cartridge injects high pressure gas into a range adjustable vortex generator of the golf club coated with platinum, rhodium, and caladium onto the top of the striker or piston, that converts the high-pressure gas into kinetic energy, which drives the golf ball. The bar receptacle containing a series of firing ports loaded with the plastic strip (or a plastic cartridge strip), provides a means for an operator to advance the bar receptacle containing the series of cartridges into a firing position, by pressing the extending bar receptacle to the next unfired cartridge.

The golf club may include a range control lever designed to float independently on a range control valve shaft, thereby avoiding failure, which occurs in any fixed lever mounting method by the use of screws, prone to become loose caused by the huge shock wave. The aft end of the cylinder is mounted in a tapered socket at an aft end of the golf club, held in place by two large screws projecting through the bottom of the golf club die casting into the aft end of the cylinder in a shear fashion and the forward end of the cylinder is held in position by the urethane spring extending into embodiment bosses. The range control lever displays a range scale marker to indicate the ball travel distance.

Further, a flared muzzle end of the cylinder provides a means to house a urethane spring brake to slow the kinetic energy at the end of the firing cycle, without the use of a stainless steel stop pin, thereby using only a urethane spring to stop the striker piston by means of a bending deflection movement of the urethane spring. The high-pressure gas discharge propels the striker/piston through the travel cycle stopping against the urethane spring. The urethane spring provides orientation, absorbs the energy, and rides in a slotted striker/piston, thereby providing a braking action at the end of the travel cycle. Other functions of the urethane spring allow quick removal for cleaning and retains the cylinder to the club head die casting.

The striker/piston face diameter may be larger, thereby forming a DB reducer ring, whereby escaping high pressure gas "blow by" from the cylinder enters the rear extended diameter groove of the striker/piston face ring, which contains a series of small holes designed to slow the high speed gas flow rate before hitting the static atmosphere, thereby reducing the DB level and adding more thrust to the striker piston. The club head die casting contains two "O" rings positioned at each end of the cylinder and are seated against the embodiment die casting bore, which seal the silencing chamber enclosure.

Further, the golf club may include an anti-skid cleat plate attached to a bottom of the golf club head (or club head) in order to prevent recoil induced as each cartridge is fired. Further, the club head recoil propels the club head in the opposite direction from the ball travel, thereby reducing the kinetic energy being applied to the ball, causing the ball to travel less distance without said anti-skid plate.

The disclosed golf club may reduce the manufacturing cost by 50% to manufacture, providing for the die-cast process to allow a large volume of cast parts to be manufactured with virtually no lead times. Further, the golf club may allow the club maintenance time to be reduced or virtually eliminated.

Further, in some embodiments, the disclosed golf club includes a series of devices for a unique quiet reliable non-conventional golf club, capable of driving a golf ball varying distances from a static position, without swinging the golf club. Further, the golf club may include a device for striker/piston braking action for providing a bending or flexing action allowed by a urethane braking material durometer to absorb the kinetic energy, induced into the striker/piston, dissipated during the flex/bending motion seating against a cam-shaped bore, thereby stopping the striker/piston. Further, the golf club may include a device for multi-cartridge power strip bar that provides a means to load the entire multi-cartridge power strip into a multi-cartridge power strip bar receptacle, to allow the advance of loads by a pressing motion. Further, the golf club may include a vortex generator chamber plating that includes an existing vortex generator with an added coating or plating of platinum, rhodium, caladium to the inside surface area of the vortex resonating chamber and vortex generator armature shaft. Further, the golf club may include an anti-skid cleat plate attached to the bottom of the golf club embodiment in order to prevent recoil induced as each cartridge is fired. Further, the golf club may include a device for floating range control lever mounting, wherein a range control lever is designed to float independently on a range control valve stem bushing mounted on a vortex generator armature shaft. Further, the golf club may include a blow-by propulsion silencer ring includes a striker/piston blow-by propulsion silencer ring to increase ball travel distance and DB reduction. Further, the golf club may include a firing pin housing cam hold down assembly that includes a firing pin housing cam hold down assembly that eliminates the prior art method, entirely, thereby lowering the cost to manufacture improving assembly complications, and being more user-friendly by including a rotatable lockdown lever. The firing pin cam lock down assembly may be designed to be inserted directly into the embodiment hozzle.

Further, in some embodiments, the golf club may include a die castable embodiment opening designed to facilitate an oval shaped firing cylinder end facing containing an "O" ring providing a shaped cam housing for the urethane brake, which extends from the embodiment enclosure perpendicular through, the striker/piston elongated slot into the opposite side of embodiment enclosure bosses.

Further, in some embodiments, the golf club may be die casted. Further, the golf club houses a shaped cam radius providing a means to deflect or bend the urethane material during the braking action movement, thereby absorbing the striker/piston kinetic energy.

Further, in some embodiments, the golf club may include a multi-cartridge power strip bar receptacle housing the entire multi-cartridge power strip. Further, the multi-cartridge power strip bar receptacle eliminates the manual reloading hardship encountered in past inventions.

Further, the golf club allows a user to advance through loads of the multi-cartridge power strip, loaded into the multi-cartridge power strip bar receptacle, advanced to the next position or cartridge by pressing the multi-cartridge power strip bar receptacle end stop button inwards to the unfired cartridge.

Further, in some embodiments, the multi-cartridge power strip bar receptacle provides for a proprietary keyed (by any means) multi-cartridge power strip, thereby assuring only the correct power level multi-cartridge power strip is used.

Further, in some embodiments, the multi-cartridge power strip bar receptacle (or moveable multi-cartridge power strip bar receptacle) mates to the firing cylinder seat over a firing injection port, sealed and held in position by a spring ball seated into the discharge port of the multi-cartridge power strip moveable bar receptacle.

Further, in some embodiments, the multi-cartridge power strip loads into the moveable multi-cartridge power strip bar receptacle for storing/consumption and provides a visual indication of the number of cartridges remaining to be consumed.

Further, in some embodiments, the golf club may include a coating or plating of platinum, rhodium, and caladium to an existing vortex generator chamber to provide a super burn rate to the gun powder residue, by raising the burning rate temperature, created by the coating, thereby solving a huge jamming problem.

Further, in some embodiments, the golf club head comprises an anti-skid plate to absorb the recoil that propels the embodiment in the opposite direction from the ball travel direction, thereby reducing the kinetic energy being applied to the ball, causing the ball to travel less distance without using the anti-skid plate.

Further, in some embodiments, the golf club may include a range control vortex generator shaft extending through a firing cylinder stem hole sealed by an "O" ring, where the shaft provides a pressure gas deflector shaped to enhance the gas resonation in the vortex camber.

Further, failure occurs in any fixed range control lever mounting method using screws, which are prone to become loose caused by the huge shock wave. Further, the disclosed golf club mounts the range control lever on a keyed floating ring/sleeve on a range control shaft, with the shaft end terminated in a tapered socket at the aft end of the embodiment bore.

Further, in some embodiments, the golf club may include a firing cylinder held in place by two large screws projecting through the bottom of the embodiment into the aft end of the firing cylinder in a vertical shear fashion and the forward end of the firing cylinder is held in position by urethane spring extending into embodiment bosses.

Further, in some embodiments, the golf club may include a vortex generator chamber, located in the aft end of the firing cylinder, to provide a means to force burning gun powder gas into a vortex pattern, thereby sending unburned powder back into the burning in-coming powder, interfaces in the present invention with the movable multi-cartridge power strip bar receptacle discharge ports.

Further, in some embodiments, the golf club may include a propulsion silencer ring encompassed in a groove ring protruding diameter of the striker/piston, whereby expanding gas bypassing the piston, enters the protruding ring groove.

Further, in some embodiments, the golf club may include a shaped protruding ring that captures the blow by gas, to reverse the expanding gas flow in the opposite direction, whereby the expanding gas adds additional thrust to the striker/piston.

Further, in some embodiments, the golf club may include a device integrated into the striker/piston to convert the firing cylinder "blow by" gas pressure into kinetic energy and provide a means to reduce the DB level through a plurality of sized exit ports.

Further, in some embodiments, a selected cartridge is locked into the firing position by means of a rotary lever-operated cam assembly, integrated into the golf club handle shaft end. The lever operated cam assembly, unlocks the spent cartridge after firing, allowing the moveable multi-cartridge power strip bar receptacle to move to the next cartridge.

Further, in some embodiments, a lever operated hole down cam assemble may be connected to the end of the golf club handle shaft and designed to be housed in the golf club embodiment hozzle.

Further, in some embodiments, the golf club may include a lever operated cam that provides a housing for the firing pin and the firing pin return spring.

Further, in some embodiments, a multi-cartridge power strip bar receptacle may include a proprietary key shaped pattern in a top loading surface of the multi-cartridge power strip bar receptacle. Further, the multi-cartridge power strip bar receptacle may be designed to mate with or receive the notched end tabs or strip side cutouts in the multi-cartridge power strip, thereby allowing only a correct power level multi-cartridge power strip to engage into the multi-cartridge power strip bar receptacle.

Objects and Advantages

Besides the objectives and advantages described above, to be more specific the objectives and advantages of the disclosed golf club are:

(a) To provide a unique low-cost quiet golf club, that is safe, operational, easy to use and easy to manufacture by being designed to be die cast as opposed to investment casting.

(b) To provide a unique golf club containing a bar action receptacle containing a series of gun powder filled cartridges, when fired develops high pressure gas, which flows through a super reside burner into said vortex generator disbursement, imperative to controlling the linear distance a golf ball travels.

(c) To provide a unique golf club capable of hitting golf balls multiple distances from a static position without fouling or jamming.

(d) To provide a unique golf club containing a striker/piston made of solid construction.

(e) Containing a DB reducer thrust ring.

(f) To provide a unique golf club containing a striker/piston not requiring a rod bearing and requiring little lubrication.

(g) To provide a unique golf club striker/piston containing a urethane deflection braking capability.

(h) To provide a unique golf club striker/piston containing a special hard anodized Teflon-impregnated coating or a ceramic coating and a super residue burner by means of a vortex generator coated with platinum, rhodium, and caladium.

(i) To provide a unique golf club die casting made of aluminum, one-piece construction.

(j) To provide a unique golf club utilizing a plastic strip containing a series of cartridges.

(k) To provide a unique golf club containing an easy-to-read, ball travel distance indicator.

(l) To provide a unique golf club containing, an easy-to-use vertical hold-down cam.

(m) To provide a unique golf club containing an easy to assemble handle assembly housing the firing pin assembly.

(n) To provide a unique golf club containing a firing cylinder made of 17-4 stainless steel or other hard material.

(o) To provide a unique golf club containing a removable through urethane deflection stop pin, which allows for easy cleaning, and: disassembly.

(p) To provide a unique golf club containing a recoil surface cleat.

The reference numerals in drawings are the following:

14 is the complete golf club assembly.
15 is the silencing expansion area.
16 is the urethane spring retainer.
17 is the urethane spring housing expansion area.
18 is the index spring ball.
19 is the firing pin retaining slot.
20 is the range control valve retaining lock nut.
21 is the golf club shaft.
22 is the range control valve retaining nut.
23 is the handle assembly lower grip.
24 is the upper grip cocking handle.
25 is the firing safety button.
26 is the firing trigger button.
27 is the golf ball.
28 is the right side club head embodiment.
29 is the left side club head embodiment.
30 is the locking cam lever.
31 is the cartridge bar housing.
32 is the club head anti-skid cleat plate.
33 is the urethane spring snubber.
34 is the logo medallion.
35 is the club face.
36 is the range control lever housing slot.
37 is the range scale inset mounting.
38 is the locking cam lever slot.
39 is the firing pin cam assemble housing.
40 is the multi-cartridge power strip.
41 is the multi-cartridge power strip bar guide groove.
42 is the cartridge load.
43 is the cartridge load.
44 is the cartridge load.
45 is the cartridge load.
46 is the cartridge load.
47 is the bar receptacle removable tab stock.
48 is the bar receptacle end stop.
49 is the multi-cartridge power strip bar cartridge receptacle.
50 is the multi-cartridge power strip bar cartridge receptacle.
51 is the multi-cartridge power strip bar cartridge receptacle.
52 is the multi-cartridge power strip bar cartridge receptacle.
53 is the multi-cartridge power strip bar cartridge receptacle.
54 is the multi-cartridge power strip bar.
55 is the multi-cartridge power strip with loads.
56 is the firing cylinder top view.
57 is the firing cylinder side view.
58 is the firing cylinder end view.
59 is the range control valve housing.
60 is the multi-cartridge power strip bar cylinder port bed.
61 is the firing cylinder port.
62 is the range control valve stem O ring groove.
63 is the range control valve stem housing bearing.
64 is the vortex resonating chamber.
65 is the firing cylinder bore.
66 is the firing cylinder multi-cartridge power strip bar retainer guide.
67 is the firing cylinder aft end.
68 is the firing cylinder mounting threaded hole.
69 is the firing cylinder.
70 is the range control lever.
71 is the range control key.
72 is the range control stem bushing.
73 is the anti-skid cleat.
74 is the anti-skid cleat.
75 is the anti-skid cleat.
76 is the anti-skid cleat.
77 is the striker/piston inset below bearing surface.
78 is the piston top.
79 is the urethane brake cam.
80 is the striker/piston urethane spring guide slot.
81 is the striker/piston blow-by propulsion silencer ring.
82 is the striker piston bearing surface.
83 is the striker/piston face DB silencing port.
84 is the striker face ball traction groove.
85 is the striker/piston.
86 is the striker/piston face cutaway.
87 is the striker/piston face piston top and propulsion ring.
88 is the striker/piston face ring of silencing ports.
89 is the aft side embodiment.
90 is the strike/piston aft end piston cam brake.
91 is the range control valve.
92 is the range control vent down slot.
93 is the range control valve body.
94 is the vortex generator armature shaft with platinum catalyst coating.
95 is the vortex generator chamber seal deflector.
96 is the range control mounting threads.
97 is the range control shaft key lever connector.
98 is the forward cylinder mounting "O" ring groove.
99 is the urethane spring housing boss.
100 is the urethane spring housing boss.
101 is the cylinder after cycle vent.
102 is the cylinder after cycle vent.
103 is the cylinder after cycle pre-vent.
104 is the cylinder after cycle pre-vent.
105 is the range control valve stem end.
106 is the range control valve inlet port.
107 is the range control valve inlet port.
108 is the range control valve inlet port.
109 is the range control valve inlet port.
110 is the range control valve inlet port.
111 is the range control valve inlet port.
112 is the range control valve inlet cone.
113 is the range control stem key way.
114 is the aft cylinder "O" ring groove.
115 is the multi-load strip hold-down lower cam.
116 is the multi-load down assembly.
117 is the firing pin return spring.
118 is the firing pin.
119 is the multi-load strip hold-down upper cam.
120 is the multi-load hold-down assembly housing.
121 is the multi-load hold-down assembly mounting hole.
122 is the firing pin hammer.
123 is the firing pin hammer linkage rod.
124 is the shaft spring housing.
125 is the lower main firing pin spring retainer.
126 is the main firing pin spring.
127 is the lock down lever stop pin.
128 is the cylinder bore with urethane spring deflected.

129 is the cylinder bore without urethane spring.
130 is the cylinder bore with urethane spring un-deflected.
131 is the handle assembly cocked unfired.
132 is the handle assembly un-cocked fired.
133 is the firing linkage rod latch.
134 is the firing linkage rod in handle area.
135 is the lower handle grip.
136 is the handle frame.
137 is the cocking handle sleeve keeper actuator.
138 is the upper cocking pawl.
139 is the upper handle grip.
140 is the cocking handle sleeve return spring.
141 is the aft cocking handle sleeve return spring keeper.
142 is the cocking handle sleeve.
143 is the forward cocking handle sleeve return spring keeper.
144 is the trigger hinge pin.
145 is the safety slide.
146 is the firing trigger.

The present disclosure describes a means for driving a golf ball utilizing a ballistic impeller golf club, which uses a series of cartridges, contained in a movable, replaceable cartridge strip bar action receptacle. The bar action receptacle solves the reloading hardship in past inventions and provides a means for the user to advance through the strip of cartridges by pressing the bar action receptacle inward to advance to the next cartridge load. The present invention includes a gas reversal thruster to increase ball travel distance and reduce the DB level output by venting high pressure gas flowing through a series of sound-absorbing ports.

This disclosed golf club includes a firing pin housing cam assembly, thereby lowering the cost of manufacture and improving assembly complications and more user-friendly, where major parts are designed to be die cast, thereby lowering the manufacturing cost. The person reviewing this invention will clearly see and understand the importance of an invention to function and perform flawlessly in the marketplace. The scope of this invention far exceeds and improves all prior art by using fewer parts and ease of operation among other ramifications. This disclosed golf club reduces the cost of manufacture and provides higher reliability by implementing a 17-4 stainless steel or other stronger material cylinder, combined with a hard-coated Teflon or ceramic material on a one-piece striker/piston to solve the lubrication problem as well as elimination of structural failure. This invention contains a silencing chamber to reduce the DB sound level output, including an added DB reducer thruster ring added to the striker/piston. A urethane braking means is provided utilizing a deflection method for deceleration of the striker/piston. Other variations are possible, such as golf clubs that are multi-colored, and manufactured for people that are left-handed of smaller stature.

The present disclosure describes a series of devices for a unique quiet reliable non-conventional golf club, capable of driving a golf ball varying distances from a static position, without swinging the golf club, by utilizing a power strip, containing a series of blank gun powder cartridges loaded into a moveable bar, giving the user the ability to reload by a simple pressing motion of the power strip bar action for reloading. The striker/piston is propelled outward from the club face two inches to strike a golf ball, after the user presses two buttons on the golf club handle grip to fire the cartridge, developing a high-pressure gas injected into the breech end of the club head firing cylinder. The vortex generator disperses the gas according to a desired distance setting by the user, to achieve various distances required in playing the game of golf.

The disclosed golf club pertains to the field of golf clubs, specifically to powder actuated golf clubs igniting a propellant to drive a golf ball along the course of play, including a means of changing the distance a ball will travel according to golf course terrain requirements.

Further, the disclosed golf club may include a handle grip consisting of a hollow shaft attached to a golf club embodiment assembly designed to propel a golf ball from a static position, without swinging the club. The handle contains the triggering device, which releases the spring-loaded firing pin after being enabled by a safety release button, to launch the golf ball.

Figure 10:
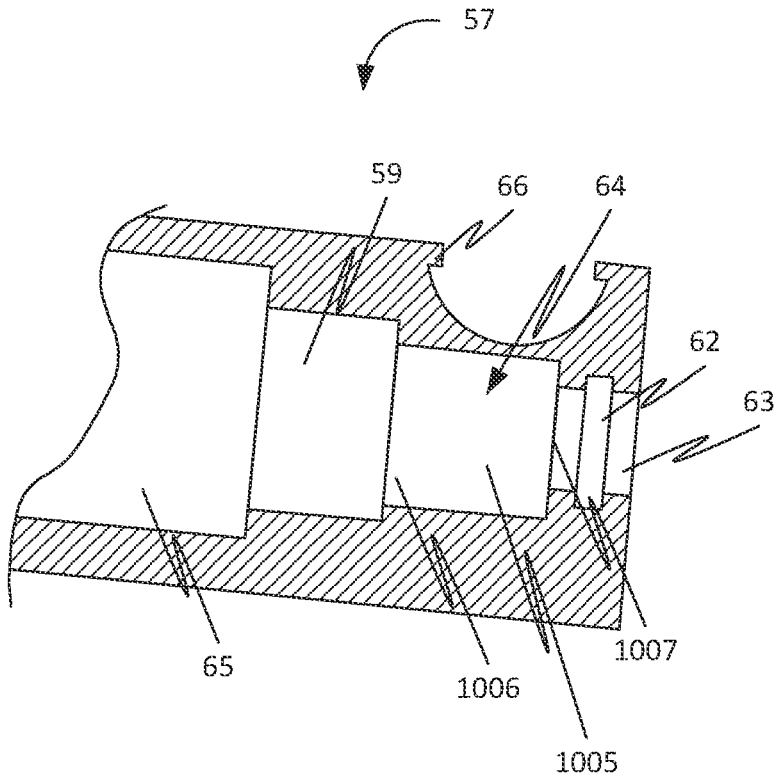
FIG. 10 is a cutaway view of an aft end of a firing cylinder 69 of the propellent-driven golf club 14 to propel a ball without requiring a swinging action on the propellent-driven golf club 14, in accordance with some embodiments.
Figure 14:
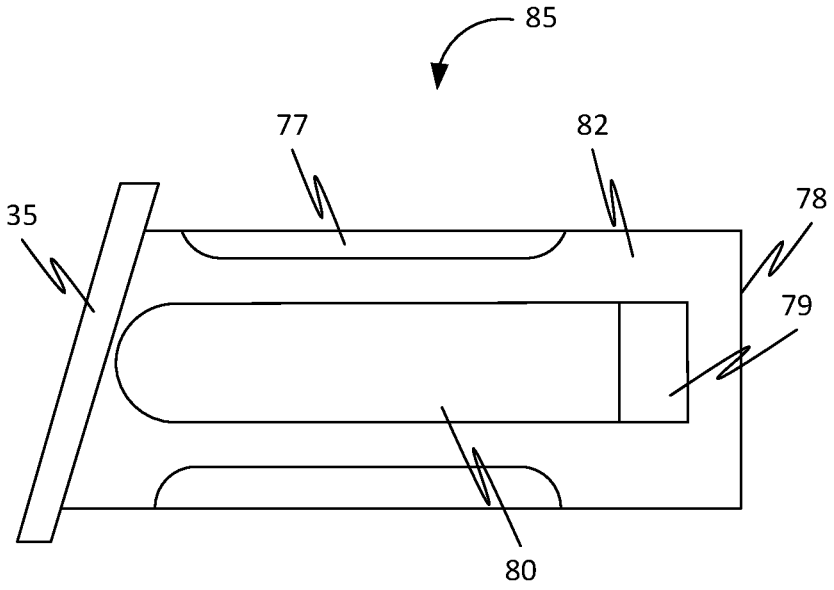
FIG. 14 is a side view of the striker piston 85 of the propellent-driven golf club 14 to propel a ball without requiring a swinging action on the propellent-driven golf club 14, in accordance with some embodiments.
Figure 23:
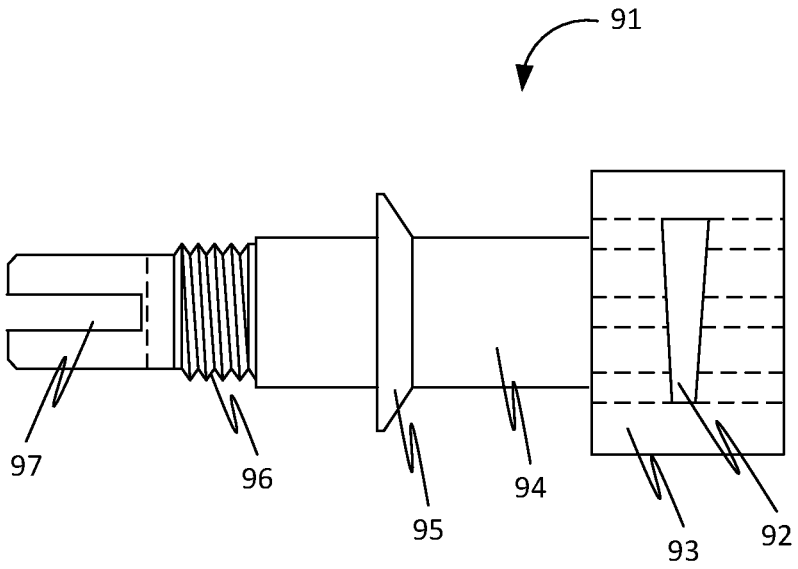
FIG. 23 illustrates the range control valve 91, in accordance with some embodiments.
Figure 26:
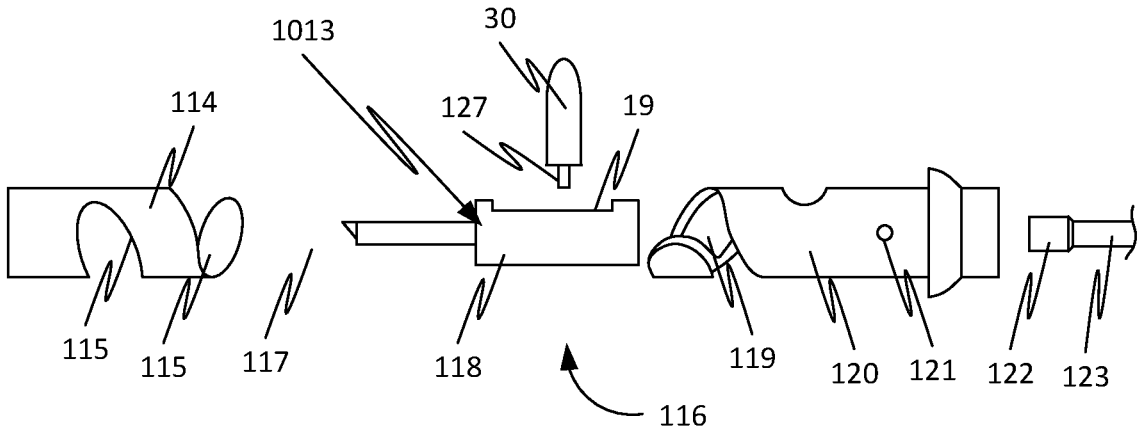
FIG. 26 is an exploded view of the firing pin cam assembly 116, in accordance with some embodiments.

FIG. 1 is a front perspective view of a propellent-driven golf club 14 to propel a ball without requiring a swinging action on the propellent-driven golf club 14, in accordance with some embodiments. Accordingly, the propellent-driven golf club 14 may include a hollow shaft 21. Further, the propellent-driven golf club 14 may include a handle 23 attached to a top portion 1001 of the hollow shaft 21. Further, the handle 23 may include a triggering device 1002 configured for actuating a firing mechanism 1013 (as shown in FIG. 26). Further, the propellent-driven golf club 14 may include a golf club head assembly 89 attached to a bottom portion 1004 of the hollow shaft 21. Further, the golf club head assembly 89 may include a bar receptacle 54 that may include a plurality of receptacles 49-53 configured to receive a plurality of cartridges 42-46. Further, the golf club head assembly 89 may include the firing mechanism 1013 operationally coupled to the triggering device 1002. Further, the firing mechanism 1013 may be configured for firing a cartridge 42 of the plurality of cartridges 42-46 upon the actuating. Further, firing the cartridge 42 generates gases. Further, the golf club head assembly 89 may include a firing cylinder port 61 configured to mate with at least a portion of the cartridge 42. Further, the golf club head assembly 89 may include a vortex generator 64 comprising a chamber 1005 (as shown in FIG. 10) that may include an ingress port 1006 (as shown in FIG. 10) and an egress port 1007 (as shown in FIG. 10). Further, the ingress port 1006 may be fluidly coupled to the firing cylinder port 61 in order to receive the gases. Further, an interior profile of the chamber 1005 may be deflected to enhance gas resonation. Further, the golf club head assembly 89 may include a range control mechanism 1008 comprising a range control valve 91 (as shown in FIG. 23) fluidly coupled to the egress port 1007 of the chamber 1005. Further, the range control valve 91 may be configured to control a pressure of the gases at an outlet of the range control valve 91. Further, the golf club head assembly 89 may include a firing cylinder bore 65 fluidly coupled to the outlet of the range control valve 91. Further, the golf club head assembly 89 may include a piston 85 (as shown in FIG. 14) movably disposed in the firing cylinder bore 65. Further, the gases drive the piston 85. Further, a free end of the piston 85 may be configured to strike the ball.

Further, in some embodiments, the chamber 1005 may include a coating of platinum, rhodium, and caladium on an inside surface of the chamber 1005.

Further, in some embodiments, the piston 85 may include a propulsion silencing ring 81 disposed around a periphery of the cylinder bore proximal to a club face 35 of the propellent-driven golf club 14. Further, the propulsion silencing ring 81 may include a plurality of ports 83 configured for filtering the gases received upon driving the piston 85. Further, the filtering of the gases reduces a sound decibel level associated with the firing of the cartridge 42.

Figure 6:
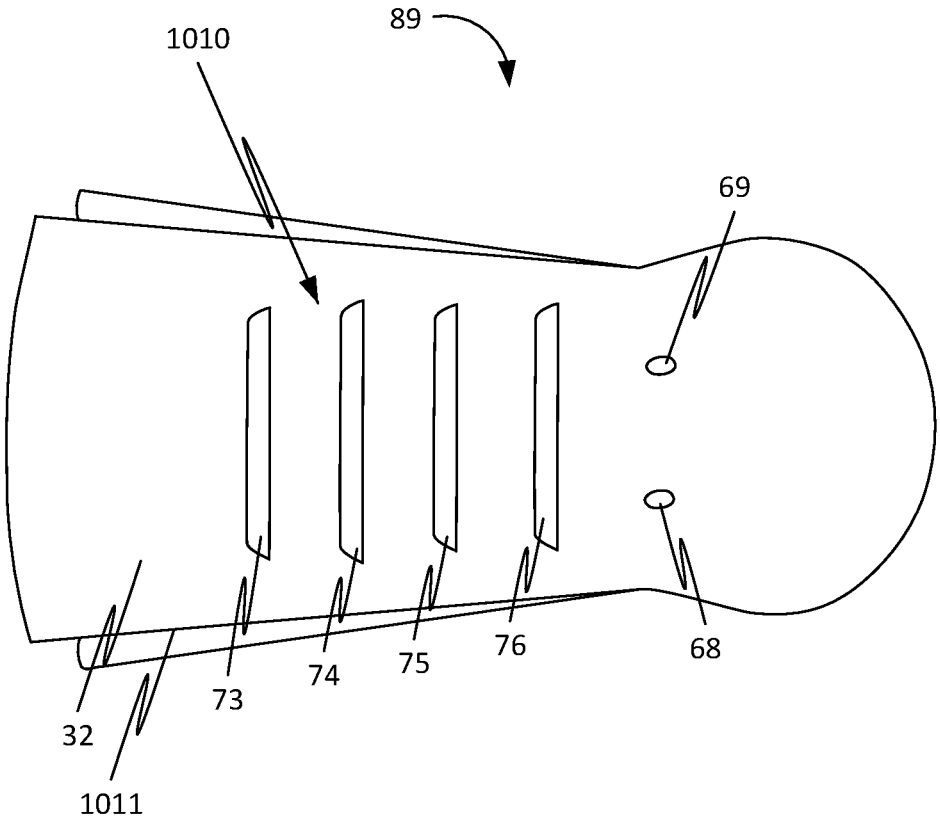
FIG. 6 is a bottom view of the propellent-driven golf club 14 to propel a ball without requiring a swinging action on the propellent-driven golf club 14, in accordance with some embodiments.

In further embodiments, the propellent-driven golf club 14 may include an anti-skid mechanism 1010 (as shown in FIG. 6) disposed on a bottom surface 1011 (as shown in FIG. 6) of the golf club head assembly 89. Further, the anti-skid mechanism 1010 may include a cleat plate 32 comprising a plurality of cleats 73-76. Further, the plurality of cleats 73-76 generates a frictional force between the bottom surface 1011 and an external ground surface. Further, the propellent-driven golf club 14 rests on the external ground surface during the propelling of the ball. Further, the frictional force resists a recoil motion imparted to the propellent-driven golf club 14 based on the firing of the cartridge 42.

Further, in some embodiments, the cylinder bore may include a piston bearing surface 82 and a plurality of piston grooves 77 disposed on an inner surface of the cylinder bore. Further, the piston 85 slides on the piston bearing surface 82. Further, sliding of the piston 85 corresponds to driving of the piston 85.

In further embodiments, the propellent-driven golf club 14 may include a hard anodized teflon coating impregnated on at least one of the piston 85, the piston bearing surface 82, and the plurality of piston grooves 77. Further, the hard anodized teflon coating reduces friction between the piston 85 and the piston bearing surface 82 for facilitating the sliding of the piston 85.

In further embodiments, the propellent-driven golf club 14 may include a ceramic coating on at least one of the piston 85, the piston bearing surface 82, and the plurality of piston grooves 77. Further, the ceramic coating reduces friction between the piston 85 and the piston bearing surface 82 for facilitating the sliding of the piston 85.

Further, in some embodiments, the range control mechanism 1008 may include a range control lever 70 and a ball travel scale 37. Further, the range control lever 70 may be disposed proximal to the ball travel scale 37. Further, the ball travel scale 37 may include a visual representation for displaying a plurality of distances. Further, the range control lever 70 may be positionable at a plurality of positions relative to the ball travel scale 37. Further, the plurality of positions corresponds to the plurality of distances for propelling the ball.

Further, in some embodiments, the range control lever 70 may be mounted on a keyed floating sleeve 72 disposed on a range control valve shaft 94 comprised in the range control mechanism 1008. Further, the keyed floating sleeve 72 avoids loosening of the range control lever 70 on the range control valve due to shock waves generated during the firing of the cartridge 42. Further, in some embodiments, the keyed floating sleeve 72 may include a range control valve stem bushing. Further, the range control valve shaft 94 may include a vortex generator armature shaft.

Further, in some embodiments, the triggering device 1002 may include a safety button 25 and a firing button 26. Further, the safety button 25 may be operatively coupled with the firing button 26. Further, the safety button 25 may be configured to be transitioned between a pulled state and a relaxed state. Further, the firing button 26 may be configured to be transitioned between a depressed state and a raised state. Further, the actuating of the firing mechanism 1013 may include transitioning the safety button 25 to the pulled state followed by transitioning of the firing button 26 to the depressed state.

Further, in some embodiments, the golf club head assembly 89 may include a urethane spring snubber 33 extending horizontally in a piston guidance slot 80 comprised in the cylinder bore. Further, the urethane spring snubber 33 may include a receptacle for slidably receiving the piston 85. Further, the urethane spring snubber 33 facilitates maintaining an orientation of the piston 85 during firing of the cartridge 42 for striking the ball. Further, the slidably receiving of the piston 85 creates a frictional force between the urethane spring snubber 33 and the piston 85. Further, the frictional force decelerates the piston 85 upon striking the ball.

Figure 4:
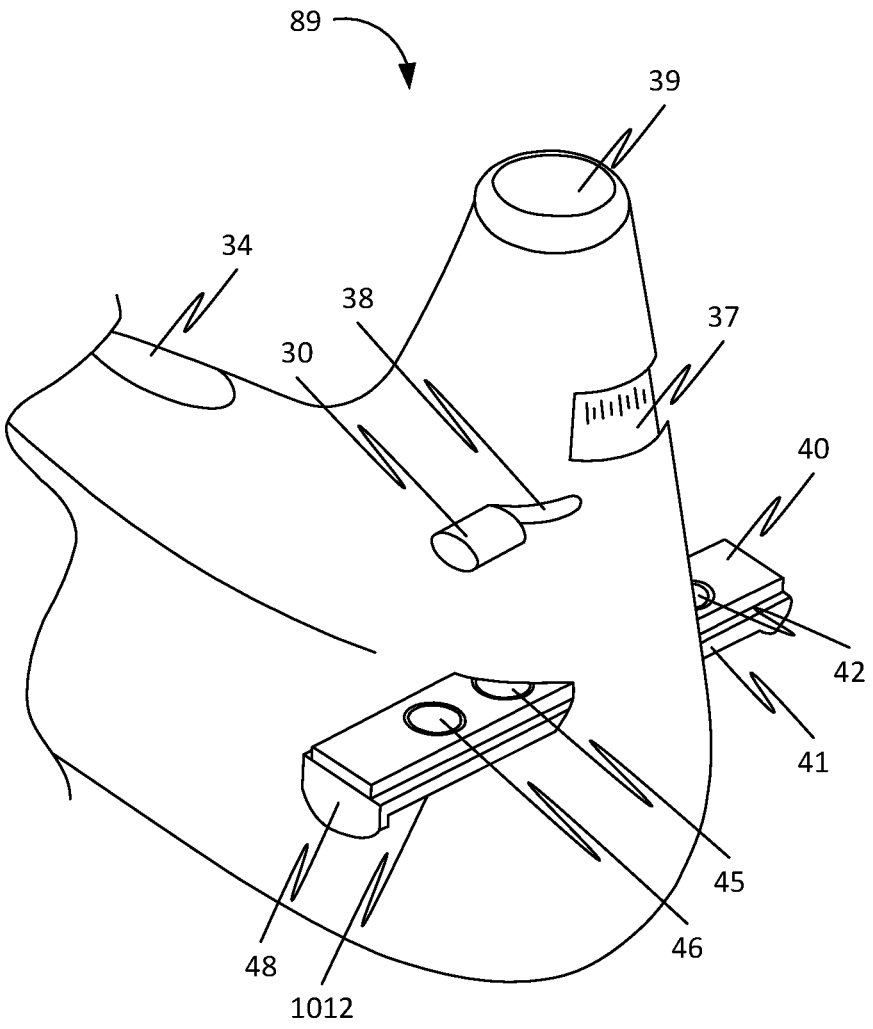
FIG. 4 is a partial rear left side perspective view of the propellent-driven golf club 14 to propel a ball without requiring a swinging action on the propellent-driven golf club 14, in accordance with some embodiments.

Further, in some embodiments, the golf club head assembly 89 may include a bar disposition mechanism 1012 (as shown in FIG. 4). Further, the bar receptacle 54 may be disposed on the bar disposition mechanism 1012. Further, the bar disposition mechanism 1012 may be configured for moving the bar receptacle 54 to a firing position based on a pressing action performed by a user to facilitate reloading of the propellent-driven golf club 14. Further, the reloading of the propellent-driven golf club 14 comprises advancing of a second cartridge 44 of the plurality of cartridges 42-46 to the firing position upon firing of the cartridge 42. Further, the firing mechanism 1013 may be configured for firing the second cartridge 44 in the firing position.

In further embodiments, disclosed herein is a propellent-driven golf club 14 to propel a ball without requiring a swinging action on the propellent-driven golf club 14. Accordingly, the propellent-driven golf club 14 may include the hollow shaft 21. Further, the propellent-driven golf club 14 may include the handle 23 attached to the top portion 1001 of the hollow shaft 21. Further, the handle 23 may include the triggering device 1002 configured for actuating the firing mechanism 1013. Further, the propellent-driven golf club 14 may include the golf club head assembly 89 attached to the bottom portion 1004 of the hollow shaft 21. Further, the golf club head assembly 89 may include the bar receptacle 54 that may include the plurality of receptacles 49-53 configured to receive the plurality of cartridges 42-46. Further, the golf club head assembly 89 may include the firing mechanism 1013 operationally coupled to the triggering device 1002. Further, the firing mechanism 1013 may be configured for firing a cartridge 42 of the plurality of cartridges 42-46 upon the actuating. Further, firing the cartridge 42 generates gases. Further, the golf club head assembly 89 may include the firing cylinder port 61 configured to mate with at least a portion of the cartridge 42. Further, the golf club head assembly 89 may include the vortex generator 64 comprising the chamber 1005 that may include the ingress port 1006 and the egress port 1007. Further, the ingress port 1006 may be fluidly coupled to the firing cylinder port 61 in order to receive the gases. Further, an interior profile of the chamber 1005 may be deflected to enhance gas resonation. Further, the golf club head assembly 89 may include the range control mechanism 1008 comprising the range control valve 91 fluidly coupled to the egress port 1007 of the chamber 1005. Further, the range control valve 91 may be configured to control a pressure of the gases at the outlet of the range control valve 91. Further, the golf club head assembly 89 may include the firing cylinder bore 65 fluidly coupled to the outlet of the range control valve 91. Further, the golf club head assembly 89 may include the piston 85 movably disposed in the firing cylinder bore 65. Further, the gases drive the piston 85. Further, a free end of the piston 85 may be configured to strike the ball. Further, the propellent-driven golf club 14 may include the anti-skid mechanism 1010 disposed on the bottom surface 1011 of the golf club head assembly 89. Further, the anti-skid mechanism 1010 may include the cleat plate 32 comprising the plurality of cleats 73-76. Further, the plurality of cleats 73-76 provides frictional force between the bottom surface 1011 and an external surface. Further, the propellent-driven golf club 14 may be disposed on the external surface. Further, the frictional force resists a recoil motion imparted to the propellent-driven golf club 14 based on the firing of the cartridge 42.

Further, in some embodiments, the chamber 1005 may include a coating of platinum, rhodium, and caladium on an inside surface of the chamber 1005.

Further, in some embodiments, the piston 85 may include the propulsion silencing ring 81 disposed around a periphery of the cylinder bore proximal to the club face 35 of the propellent-driven golf club 14. Further, the propulsion silencing ring 81 may include the plurality of ports 83 configured for filtering the gases received upon driving the piston 85. Further, the filtering of the gases reduces a sound decibel level associated with the firing of the cartridge 42.

Further, in some embodiments, the range control mechanism 1008 may include the range control lever 70 and the ball travel scale 37. Further, the range control lever 70 may be disposed proximal to the ball travel scale 37. Further, the ball travel scale 37 may include a visual representation for displaying a plurality of distances. Further, the range control lever 70 may be positionable at a plurality of positions relative to the ball travel scale 37. Further, the plurality of positions corresponds to the plurality of distances for propelling the ball.

Further, in some embodiments, the golf club head assembly 89 may include the bar disposition mechanism 1012. Further, the bar receptacle 54 may be disposed on the bar disposition mechanism 1012. Further, the bar disposition mechanism 1012 may be configured for moving the bar receptacle 54 to a firing position based on a pressing action performed by a user to facilitate reloading of the propellent-driven golf club 14. Further, the reloading of the propellent-driven golf club 14 comprises advancing of a second cartridge 44 of the plurality of cartridges 42-46 to the firing position upon firing of the cartridge 42. Further, the firing mechanism 1013 may be configured for firing the second cartridge 44 in the firing position.

In further embodiments, disclosed herein is a propellent-driven golf club 14 to propel a ball without requiring a swinging action on the propellent-driven golf club 14. Accordingly, the propellent-driven golf club 14 may include the hollow shaft 21. Further, the propellent-driven golf club 14 may include the handle 23 attached to the top portion 1001 of the hollow shaft 21. Further, the handle 23 may include the triggering device 1002 configured for actuating the firing mechanism 1013. Further, the propellent-driven golf club 14 may include the golf club head assembly 89 attached to the bottom portion 1004 of the hollow shaft 21. Further, the golf club head assembly 89 may include the bar receptacle 54 that may include the plurality of receptacles 49-53 configured to receive the plurality of cartridges 42-46. Further, the golf club head assembly 89 may include the firing mechanism 1013 operationally coupled to the triggering device 1002. Further, the firing mechanism 1013 may be configured for firing a cartridge 42 of the plurality of cartridges 42-46 upon the actuating. Further, firing the cartridge 42 generates gases. Further, the golf club head assembly 89 may include the firing cylinder port 61 configured to mate with at least a portion of the cartridge 42. Further, the golf club head assembly 89 may include the vortex generator 64 comprising the chamber 1005 that may include the ingress port 1006 and the egress port 1007. Further, the ingress port 1006 may be fluidly coupled to the firing cylinder port 61 in order to receive the gases. Further, an interior profile of the chamber 1005 may be deflected to enhance gas resonation. Further, the golf club head assembly 89 may include the range control mechanism 1008 may include the range control valve 91 fluidly coupled to the egress port 1007 of the chamber 1005. Further, the range control valve 91 may be configured to control a pressure of the gases at the outlet of the range control valve 91. Further, the golf club head assembly 89 may include the firing cylinder bore 65 fluidly coupled to the outlet of the range control valve 91. Further, the golf club head assembly 89 may include the piston 85 movably disposed in the firing cylinder bore 65. Further, the gases drive the piston 85. Further, a free end of the piston 85 may be configured to strike the ball. Further, the golf club head assembly 89 may include the bar disposition mechanism 1012. Further, the bar receptacle 54 may be disposed on the bar disposition mechanism 1012. Further, the bar disposition mechanism 1012 may be configured for moving the bar receptacle 54 to a firing position based on a pressing action performed by a user to facilitate reloading of the propellent-driven golf club 14. Further, the reloading of the propellent-driven golf club 14 comprises advancing of a second cartridge 44 of the plurality of cartridges 42-46 to the firing position upon firing of the cartridge 42. Further, the firing mechanism 1013 may be configured for firing the second cartridge 44 in the firing position. Further, the propellent-driven golf club 14 may include the anti-skid mechanism 1010 disposed on the bottom surface 1011 of the golf club head assembly 89. Further, the anti-skid mechanism 1010 may include the cleat plate 32 comprising the plurality of cleats 73-76. Further, the plurality of cleats 73-76 provides frictional force between the bottom surface 1011 and an external surface. Further, the propellent-driven golf club 14 may be disposed on the external surface. Further, the frictional force resists a recoil motion imparted to the propellent-driven golf club 14 based on the firing of the cartridge 42.

Further, in some embodiments, the piston 85 may include the propulsion silencing ring 81 disposed around a periphery of the cylinder bore proximal to the club face 35 of the propellent-driven golf club 14. Further, the propulsion silencing ring 81 may include the plurality of ports 83 configured for filtering the gases received upon driving the piston 85. Further, the filtering of the gases reduces a sound decibel level associated with the firing of the cartridge 42.

Further, in some embodiments, the range control mechanism 1008 may include the range control lever 70 and the ball travel scale 37. Further, the range control lever 70 may be disposed proximal to the ball travel scale 37. Further, the ball travel scale 37 may include a visual representation for displaying a plurality of distances. Further, the range control lever 70 may be positionable at a plurality of positions relative to the ball travel scale 37. Further, the plurality of positions corresponds to the plurality of distances for propelling the ball.

Figure 2:
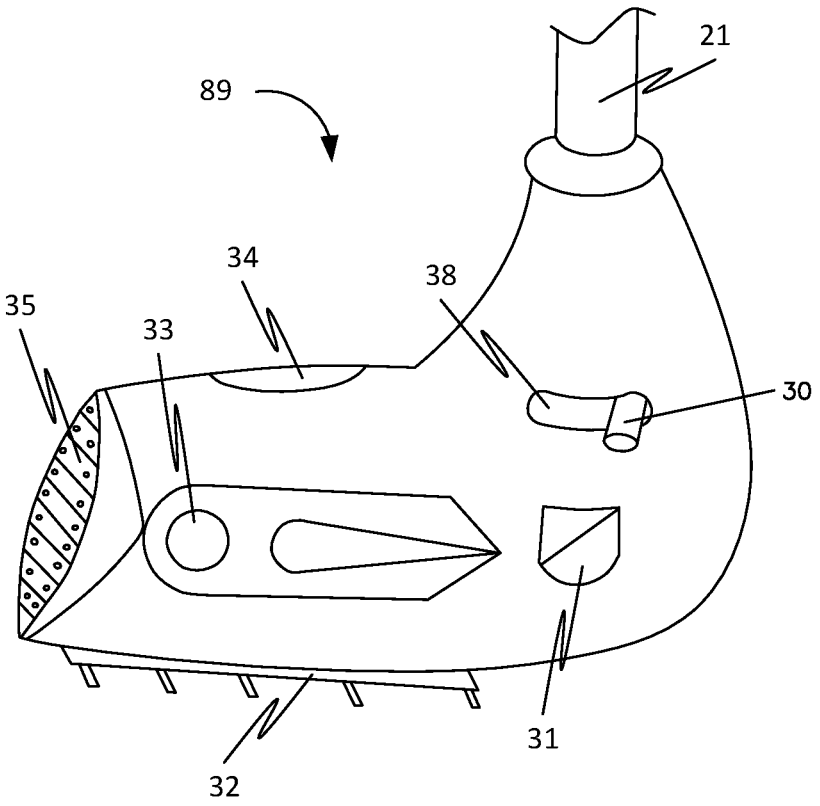
FIG. 2 is a partial left side perspective view of the propellent-driven golf club 14 to propel a ball without requiring a swinging action on the propellent-driven golf club 14, in accordance with some embodiments.

FIG. 2 is a partial left side perspective view of the propellent-driven golf club 14 to propel a ball without requiring a swinging action on the propellent-driven golf club 14, in accordance with some embodiments.

Figure 3:
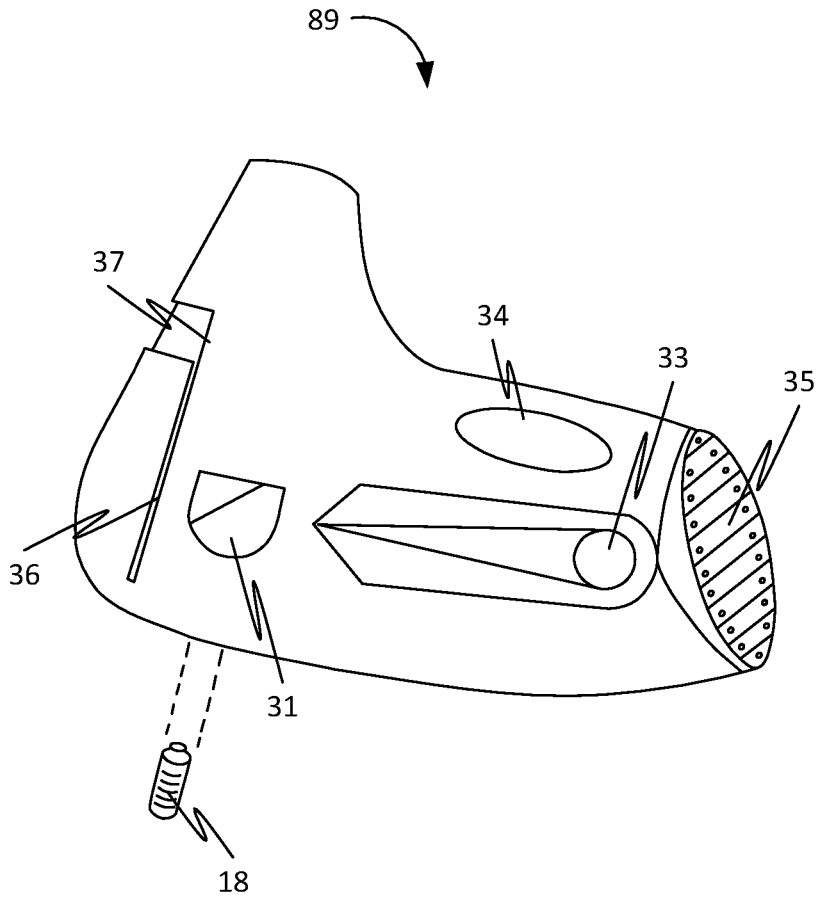
FIG. 3 is a partial right side perspective view of the propellent-driven golf club 14 to propel a ball without requiring a swinging action on the propellent-driven golf club 14, in accordance with some embodiments.

FIG. 3 is a partial right side perspective view of the propellent-driven golf club 14 to propel a ball without requiring a swinging action on the propellent-driven golf club 14, in accordance with some embodiments.

FIG. 4 is a partial rear left side perspective view of the propellent-driven golf club 14 to propel a ball without requiring a swinging action on the propellent-driven golf club 14, in accordance with some embodiments.

Figure 5:
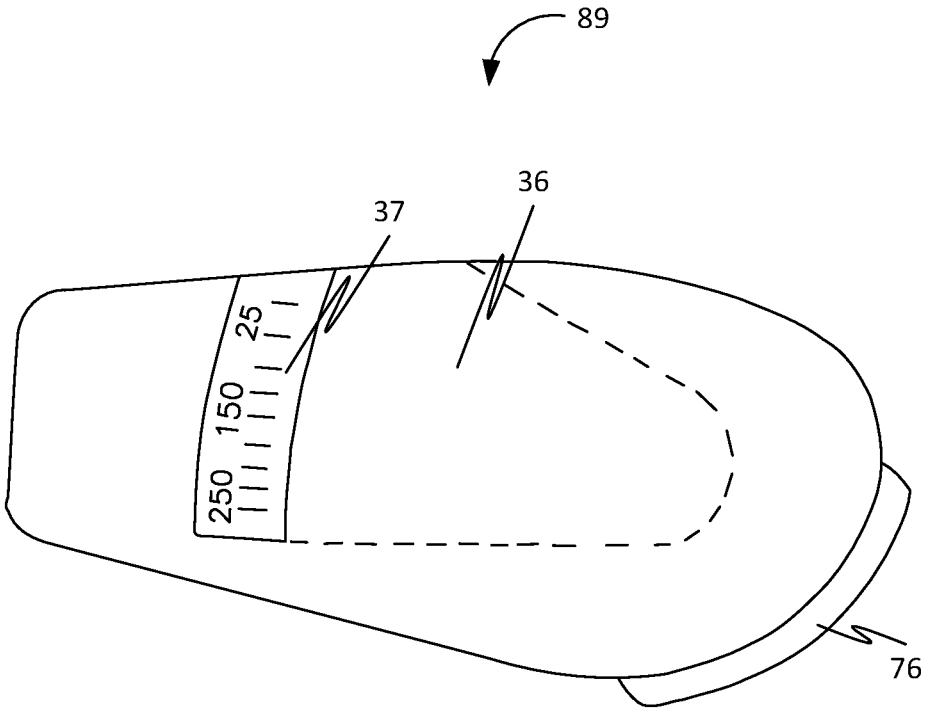
FIG. 5 is a partial rear view of the propellent-driven golf club 14 to propel a ball without requiring a swinging action on the propellent-driven golf club 14, in accordance with some embodiments.

FIG. 5 is a partial rear view of the propellent-driven golf club 14 to propel a ball without requiring a swinging action on the propellent-driven golf club 14, in accordance with some embodiments.

FIG. 6 is a bottom view of the propellent-driven golf club 14 to propel a ball without requiring a swinging action on the propellent-driven golf club 14, in accordance with some embodiments.

Figure 7:
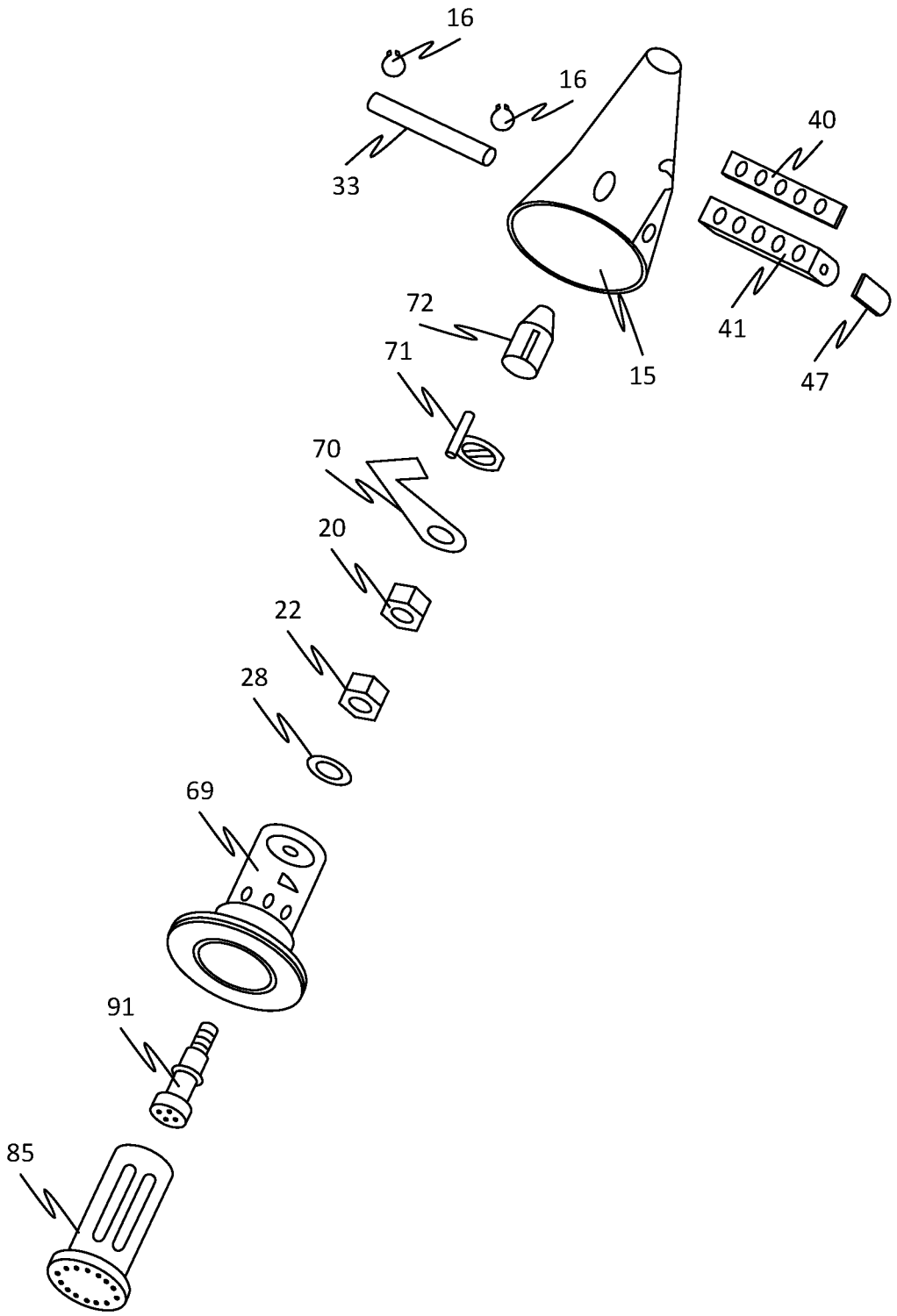
FIG. 7 is an exploded view of the golf club head assembly 89 of the propellent-driven golf club 14 to propel a ball without requiring a swinging action on the propellent-driven golf club 14, in accordance with some embodiments.

FIG. 7 is an exploded view of the golf club head assembly 89 of the propellent-driven golf club 14 to propel a ball without requiring a swinging action on the propellent-driven golf club 14, in accordance with some embodiments.

Figure 8:
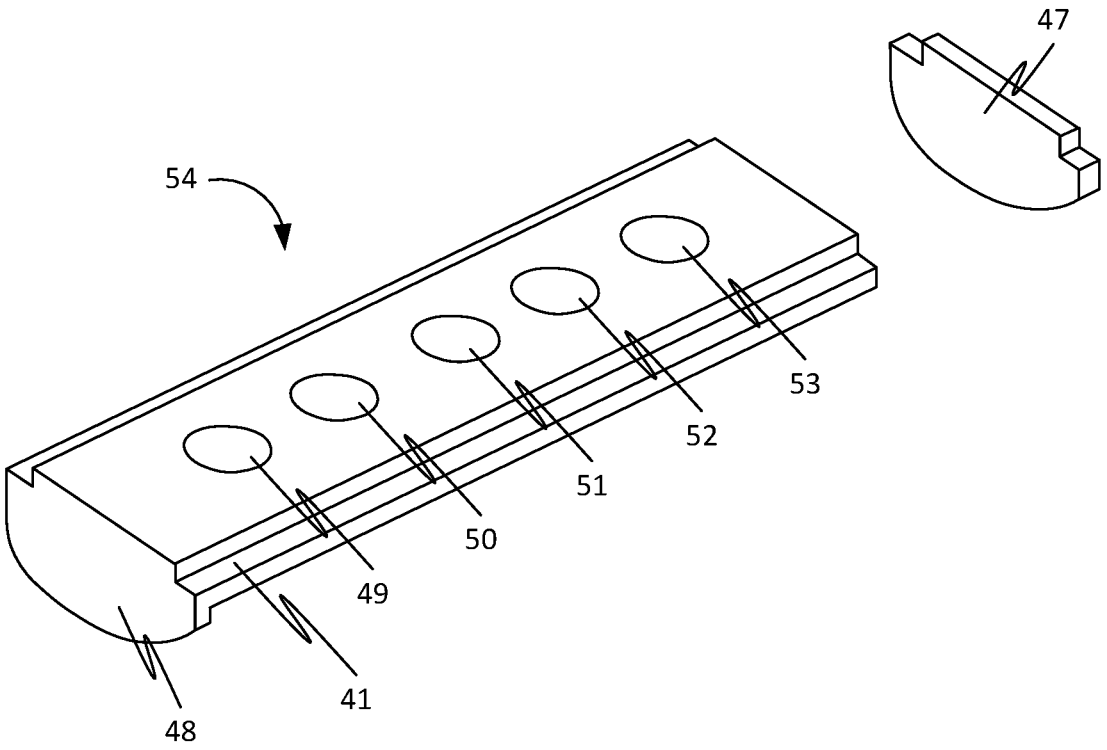
FIG. 8 illustrates the bar receptacle 54 of the propellent-driven golf club 14 to propel a ball without requiring a swinging action on the propellent-driven golf club 14, in accordance with some embodiments.

FIG. 8 illustrates the bar receptacle 54 of the propellent-driven golf club 14 to propel a ball without requiring a swinging action on the propellent-driven golf club 14, in accordance with some embodiments.

Figure 9:
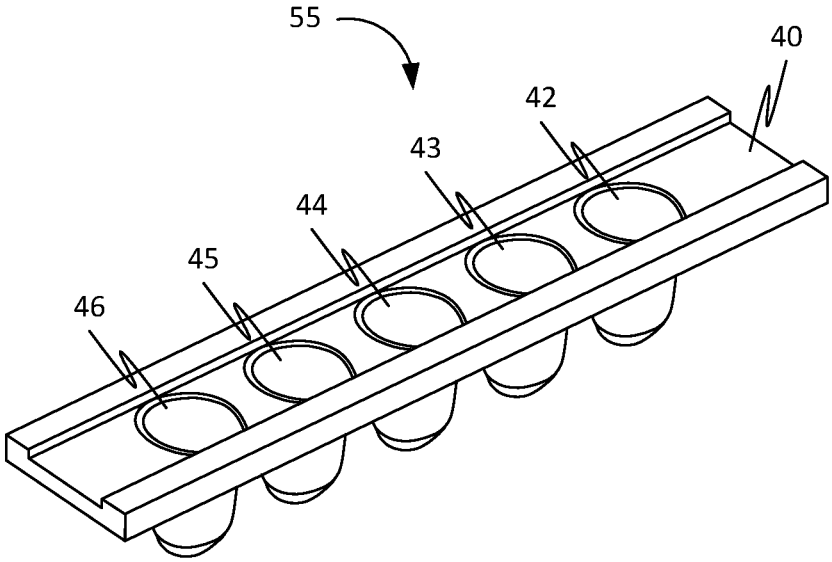
FIG. 9 illustrates the plurality of cartridges 42-46 of the propellent-driven golf club 14 to propel a ball without requiring a swinging action on the propellent-driven golf club 14, in accordance with some embodiments.

FIG. 9 illustrates the plurality of cartridges 42-46 of the propellent-driven golf club 14 to propel a ball without requiring a swinging action on the propellent-driven golf club 14, in accordance with some embodiments.

FIG. 10 is a cutaway view of an aft end of a firing cylinder 69 of the propellent-driven golf club 14 to propel a ball without requiring a swinging action on the propellent-driven golf club 14, in accordance with some embodiments.

Figure 11:
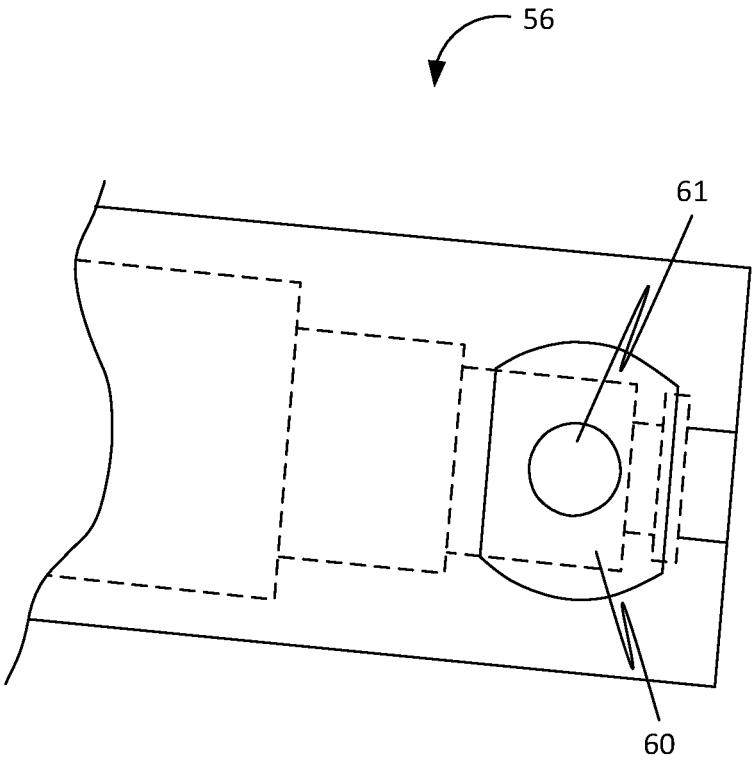
FIG. 11 is a top view of the aft end of the firing cylinder 69 of the propellent-driven golf club 14 to propel a ball without requiring a swinging action on the propellent-driven golf club 14, in accordance with some embodiments.

FIG. 11 is a top view of the aft end of the firing cylinder 69 of the propellent-driven golf club 14 to propel a ball without requiring a swinging action on the propellent-driven golf club 14, in accordance with some embodiments.

Figure 12:
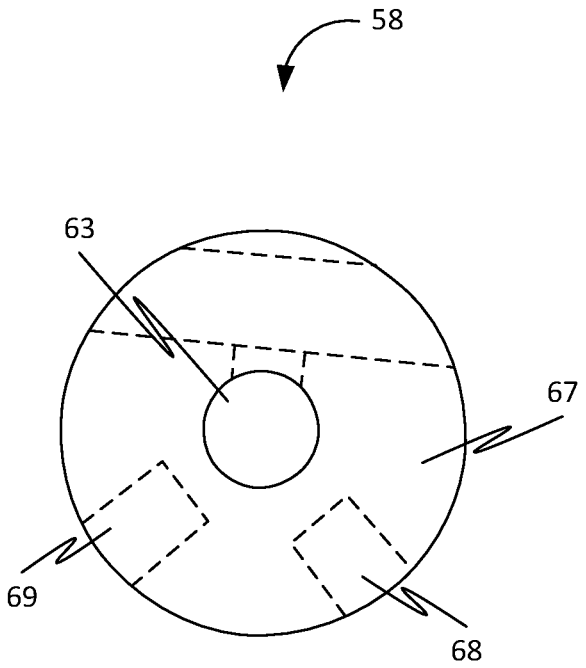
FIG. 12 illustrates the aft end of the firing cylinder 69 of the propellent-driven golf club 14 to propel a ball without requiring a swinging action on the propellent-driven golf club 14, in accordance with some embodiments.

FIG. 12 illustrates the aft end of the firing cylinder 69 of the propellent-driven golf club 14 to propel a ball without requiring a swinging action on the propellent-driven golf club 14, in accordance with some embodiments.

Figure 13:
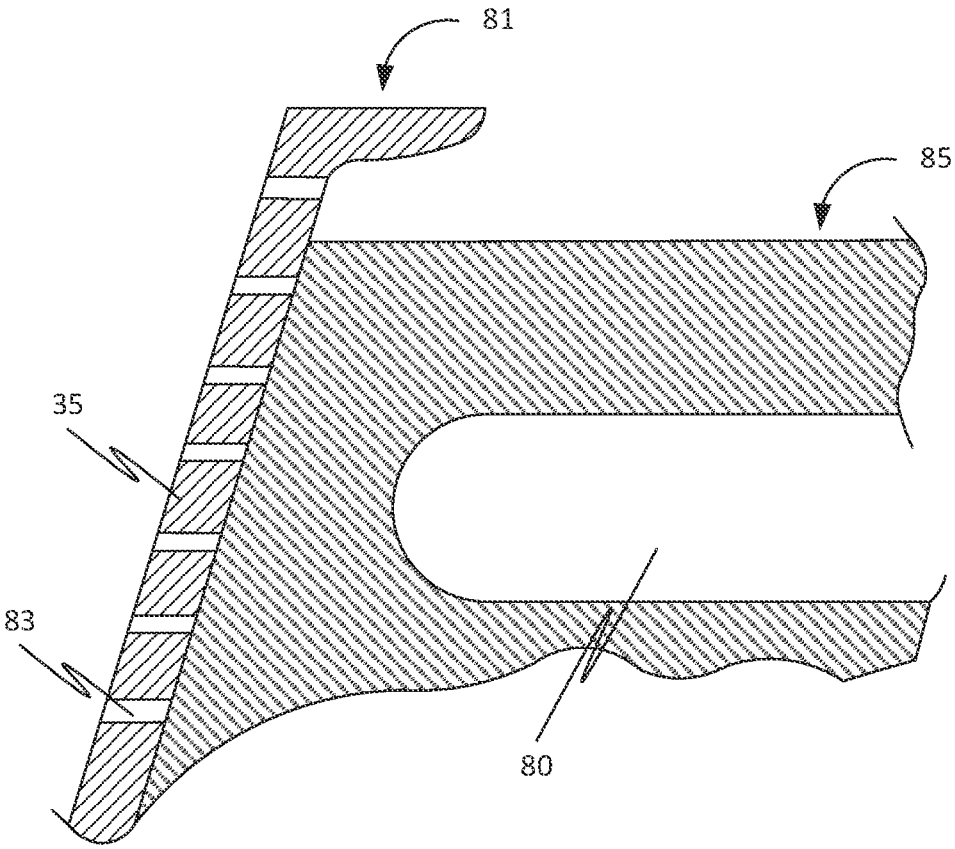
FIG. 13 is a partial cutaway view of the striker piston 85 of the propellent-driven golf club 14 to propel a ball without requiring a swinging action on the propellent-driven golf club 14, in accordance with some embodiments.

FIG. 13 is a partial cutaway view of the striker piston 85 of the propellent-driven golf club 14 to propel a ball without requiring a swinging action on the propellent-driven golf club 14, in accordance with some embodiments.

FIG. 14 is a side view of the striker piston 85 of the propellent-driven golf club 14 to propel a ball without requiring a swinging action on the propellent-driven golf club 14, in accordance with some embodiments.

Figure 15:
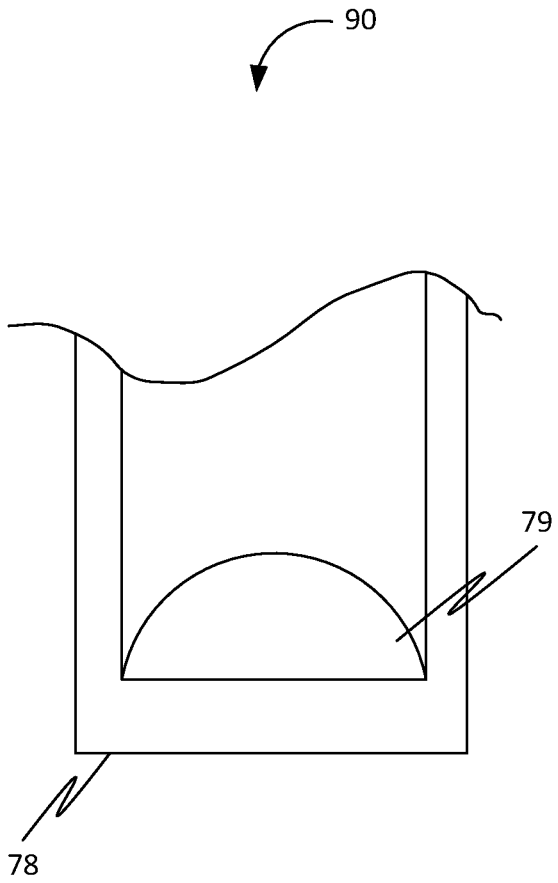
FIG. 15 is a partial cutaway top view of the urethane spring cam 79 of the propellent-driven golf club 14 to propel a ball without requiring a swinging action on the propellent-driven golf club 14, in accordance with some embodiments.

FIG. 15 is a partial cutaway top view of the urethane spring cam 79 of the propellent-driven golf club 14 to propel a ball without requiring a swinging action on the propellent-driven golf club 14, in accordance with some embodiments.

Figure 16:
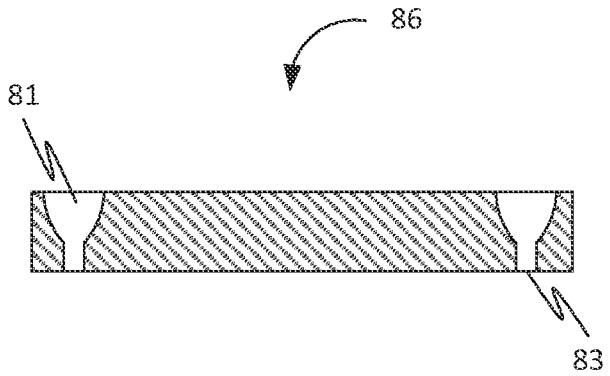
FIG. 16 is a partial cutaway view of the striker piston 85 of the propellent-driven golf club 14 to propel a ball without requiring a swinging action on the propellent-driven golf club 14, in accordance with some embodiments.

FIG. 16 is a partial cutaway view of the striker piston 85 of the propellent-driven golf club 14 to propel a ball without requiring a swinging action on the propellent-driven golf club 14, in accordance with some embodiments.

Figure 17:
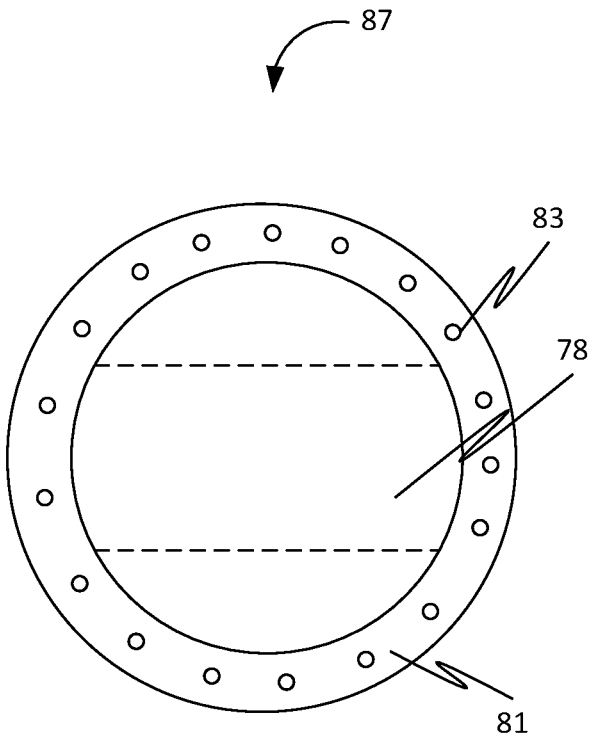
FIG. 17 is a front view of the piston 85 of the propellent-driven golf club 14 from a piston end, in accordance with some embodiments.

FIG. 17 is a front view of the piston 85 of the propellent-driven golf club 14 from a piston end, in accordance with some embodiments.

Figure 18:
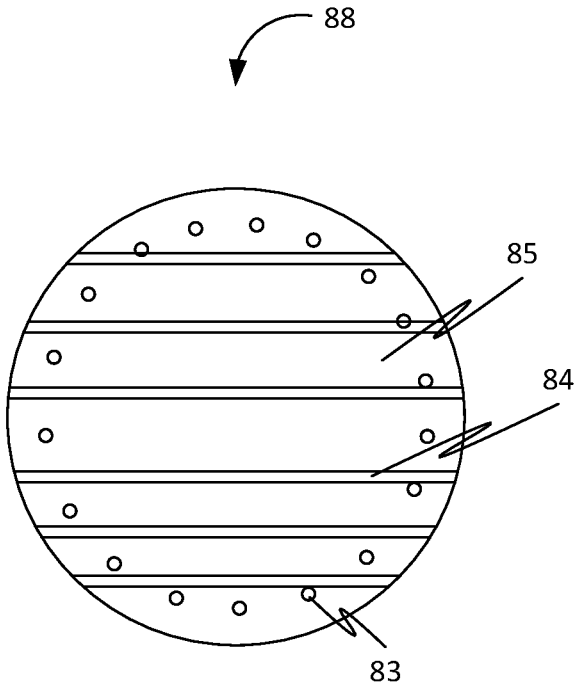
FIG. 18 illustrates the propulsion silencing ring 81 and the plurality of ports 83 of the propellent-driven golf club 14 to propel a ball without requiring a swinging action on the propellent-driven golf club 14, in accordance with some embodiments.

FIG. 18 illustrates the propulsion silencing ring 81 and the plurality of ports 83 of the propellent-driven golf club 14 to propel a ball without requiring a swinging action on the propellent-driven golf club 14, in accordance with some embodiments.

Figure 19:
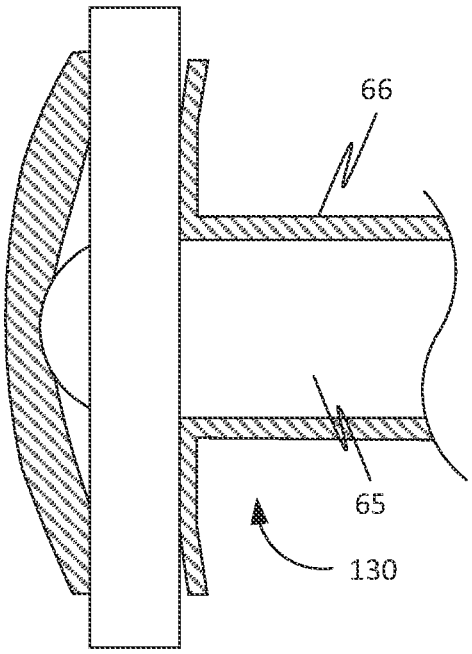
FIG. 19, illustrates a partial cutaway view of the urethane spring snubber 33 in an undeflected state, in accordance with some embodiments.

FIG. 19, illustrates a partial cutaway view of the urethane spring snubber 33 in an undeflected state, in accordance with some embodiments.

Figure 20:
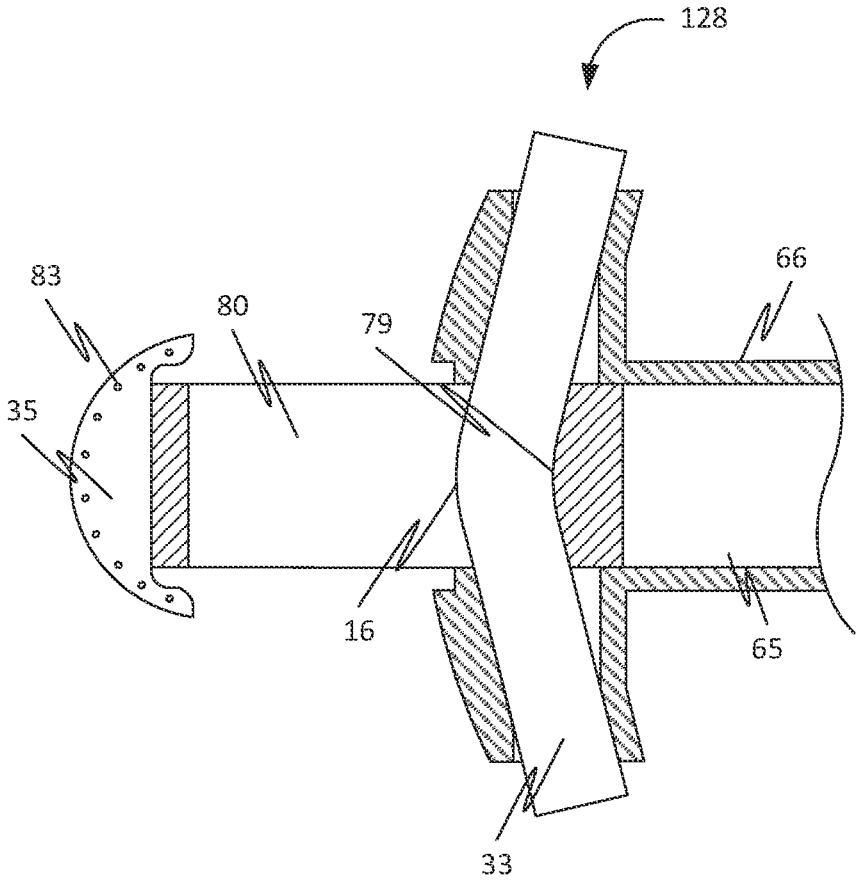
FIG. 20 is a partial cutaway view of firing cylinder 69 and striker/piston 85 with deflected urethane spring snubber 33, in accordance with some embodiments.

FIG. 20 is a partial cutaway view of firing cylinder 69 and striker/piston 85 with deflected urethane spring snubber 33, in accordance with some embodiments.

Figure 21:
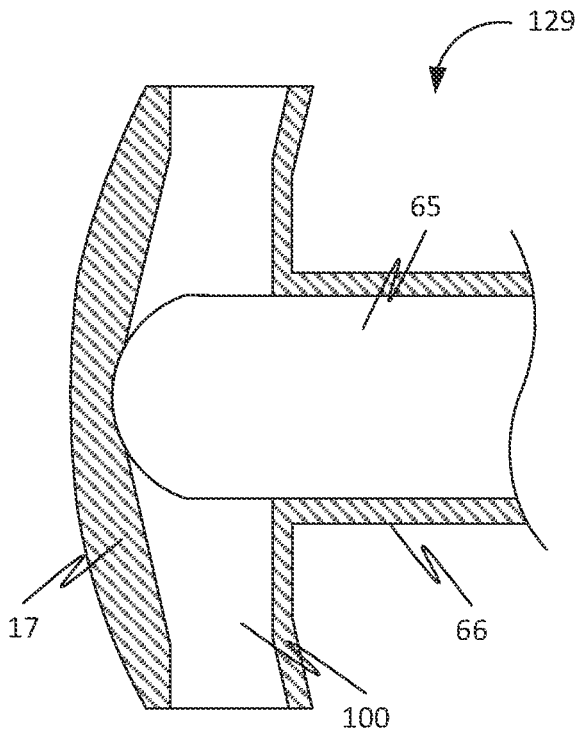
FIG. 21 is a partial cutaway view of the cylinder bore 65 without the urethane spring snubber 33, in accordance with some embodiments.

FIG. 21 is a partial cutaway view of the cylinder bore 65 without the urethane spring snubber 33, in accordance with some embodiments.

Figure 22:
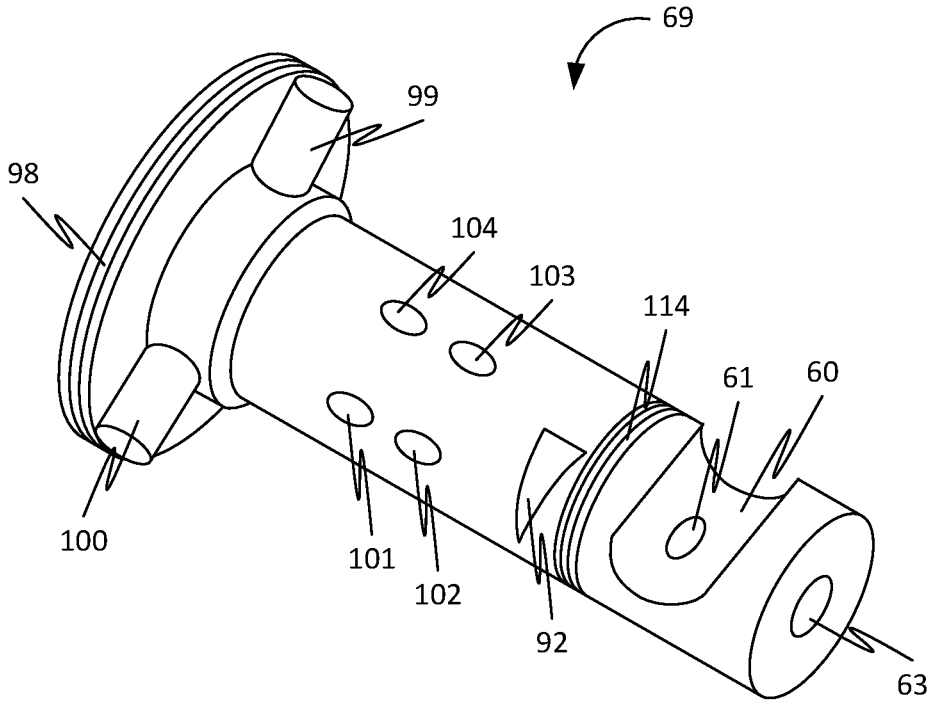
FIG. 22 is a perspective view of the firing cylinder 69, in accordance with some embodiments.

FIG. 22 is a perspective view of the firing cylinder 69, in accordance with some embodiments.

FIG. 23 illustrates the range control valve 91, in accordance with some embodiments.

Figure 24:
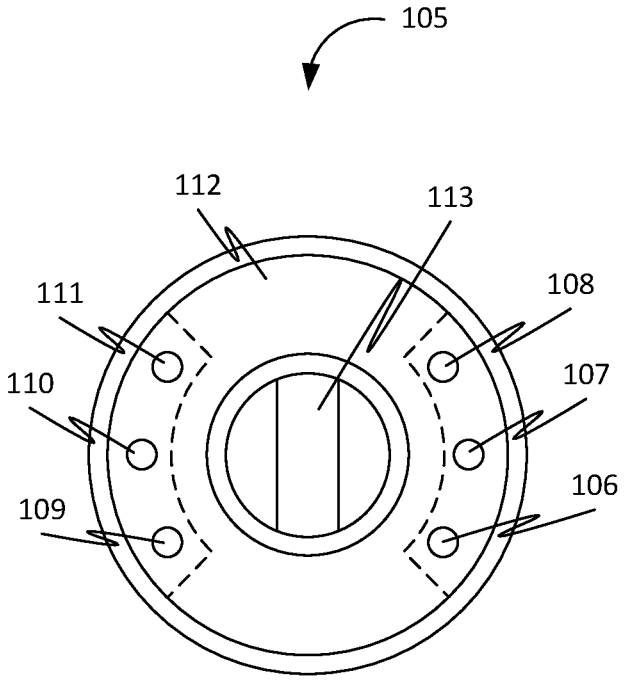
FIG. 24 illustrates a shaft end of the range control valve 91, in accordance with some embodiments.

FIG. 24 illustrates a shaft end of the range control valve 91, in accordance with some embodiments.

Figure 25:
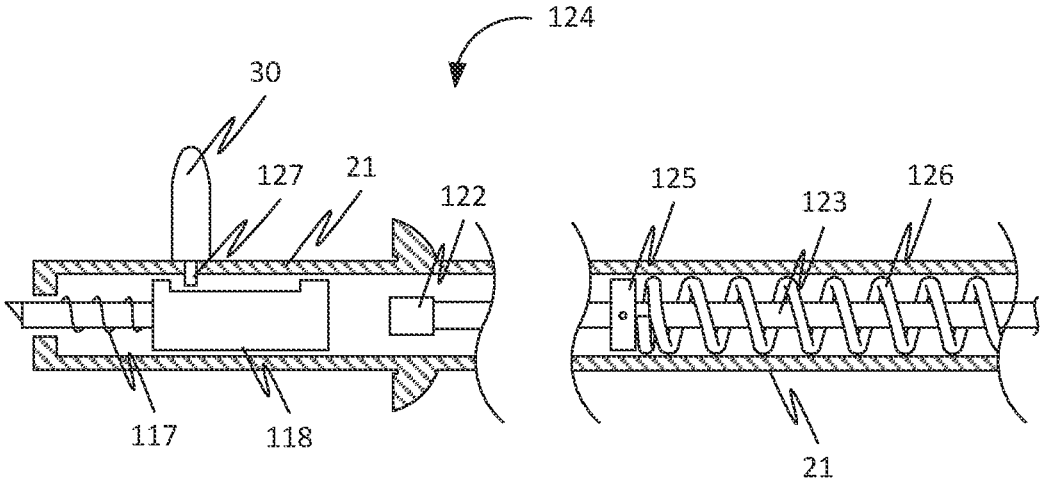
FIG. 25 is a cutaway view of the firing pin cam assembly 116, in accordance with some embodiments.

FIG. 25 is a cutaway view of the firing pin cam assembly 116, in accordance with some embodiments.

FIG. 26 is an exploded view of the firing pin cam assembly 116, in accordance with some embodiments.

Figure 27:
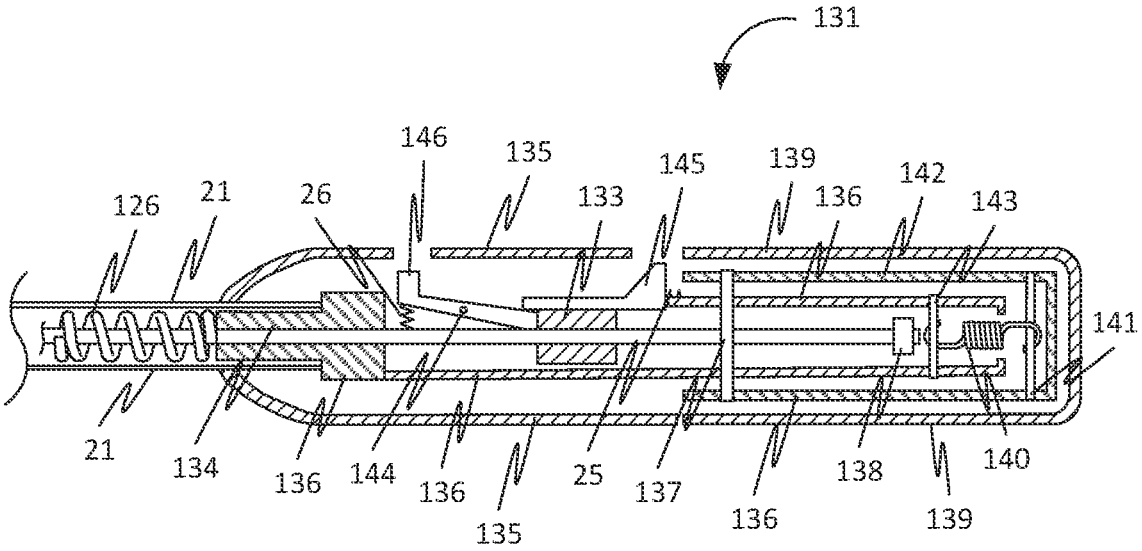
FIG. 27 is a cutaway view of a handle assembly comprised in the handle 23 in a cocked position ready to fire, in accordance with some embodiments.

FIG. 27 is a cutaway view of a handle assembly comprised in the handle 23 in a cocked position ready to fire, in accordance with some embodiments.

Figure 28:
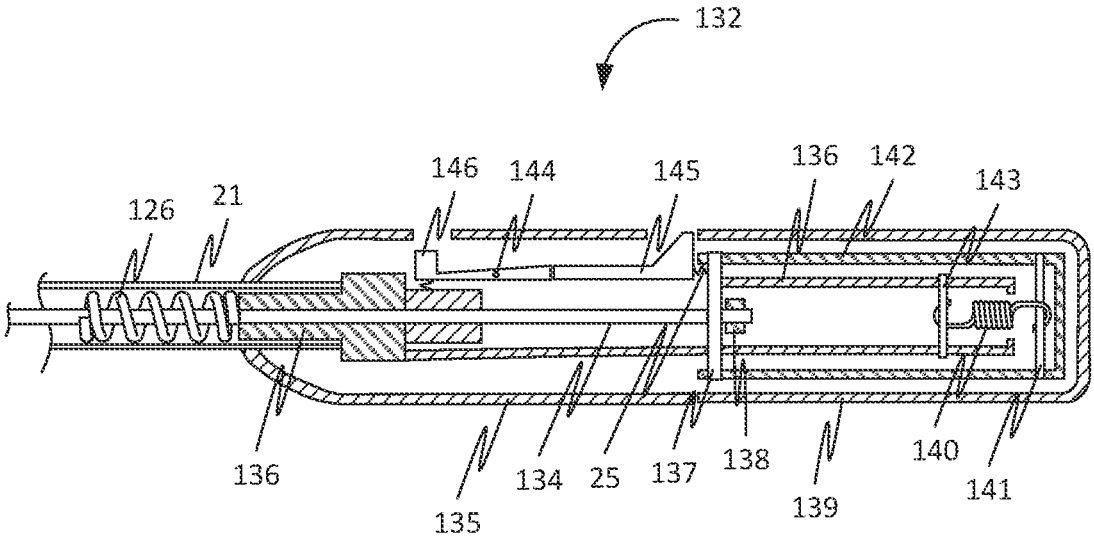
FIG. 28 is a cutaway view of the handle assembly comprised in the handle 23 in a fired position, in accordance with some embodiments.

FIG. 28 is a cutaway view of the handle assembly comprised in the handle 23 in a fired position, in accordance with some embodiments.

Further, the disclosed golf club, illustrated in FIG. 1, is completely assembled ready for use. FIG. 1 through FIG. 28 clearly illustrate each component part interconnection. The golf club head casting embodiment in FIG. 2 and FIG. 3 has an internal firing cylinder containing a striker/piston shown in the retracted position. FIG. 4 shows the aft view of the golf club head embodiment containing the bar action multi-cartridge power strip. FIG. 5 shows the aft view of the golf club head embodiment illustrated by the hidden lines, the range control lever housing underneath the visible range control scale. FIG. 6 shows the bottom view of the golf club head embodiment illustrating the anti-skid cleats and firing cylinder mounting holes. FIG. 7 shows the golf club head embodiment in an exploded view of all the internal parts. FIG. 8 shows the multi-cartridge power strip bar action illustrating the end stops. FIG. 9 shows the multi-cartridge power strip. FIG. 10 shows a cutaway view of the vortex generator, range control housing and firing cylinder bore. FIG. 11 shows the top view of the firing cylinder illustrating the bar action seat and injection port. FIG. 12 shows the piston end of the firing cylinder illustrating the range control stem bore and mounting holes. FIG. 13 shows a partial cutaway of the striker/piston illustrating the high-pressure blow-by silencing ports and the propellant silencer thruster ring around the striker face perimeter. FIG. 14 shows the side view of the striker/piston illustrating the urethane spring snubber guide slot and urethane spring snubber deceleration deflection cam. FIG. 15 shows a partial cutaway view of striker/piston illustrating the top view of the deceleration deflection cam. FIG. 16 shows a cutaway view of the thrust propulsion silencing ring and silencing port. FIG. 17 shows the high-pressure gas inlet into the thrust propulsion silencing ring ports. FIG. 18 shows the striker/piston face illustrating the friction grooves and the outlet of the high-pressure gas propulsion silencing ring ports. FIG. 19 shows a partial cutaway view of the firing cylinder illustrating the urethane spring snubber being in the static position. FIG. 20 shows a partial cutaway view of the firing cylinder and striker/piston, illustrating the urethane spring snubber being in the deflected position against the striker/piston cam. FIG. 21 shows a partial cutaway view of the firing cylinder without the urethane spring and striker/piston. FIG. 22 shows the firing cylinder illustrating the multi-cartridge power strip bar action seat, silencing vent, high pressure vent ports and the mounting flange "O" ring seals. FIG. 23 shows the range control valve illustrating the vortex generator core and the valve seating hub.

FIG. 24 shows the high-pressure gas inlet ports and index keyway. FIG. 25 shows a partial cutaway of the handle shaft assembly illustrating the firing pin assembly and main firing pin spring. FIG. 26 shows an exploded view of the firing pin assembly. FIG. 27 shows a cutaway view of the handle assembly in the cocked position before firing. FIG. 28 shows a cutaway view of the handle assembly in the un-cocked position after firing.

Operation of Figures Specification 1-28

In the disclosed golf club 14, those skilled in the art will understand the mechanical sequence described to launch a golf ball utilizing a multi-cartridge power strip bar action ballistic impeller golf club. With the golf club illustrated in FIG. 1, sitting in an upright position with the multi-cartridge power strip bar action fully loaded with a series of cartridges, a user places the golf club head embodiment 89 in FIG. 1, adjacent to golf ball 27 in FIG. 1. To launch golf ball 27, the maximum distance toward the golf course green, safety button 25, is actuated, thereby enabling firing trigger 26, to be pressed, firing a selected cartridge 42-46. Before loading or reloading the multi-cartridge power strip bar action 54, cocking handle 24, must be lifted fully upward and released, being returned by cocking handle sleeve return spring 140, to cock firing pin spring 126, in preparation for firing the golf club. Loading the multi-cartridge power strip bar action receptacle 54 into golf club head embodiment 89 is accomplished by releasing firing assembly cam lever 30 and pressing the multi-cartridge power strip bar action receptacle 54 outward from golf club head embodiment 89 until the multi-cartridge power strip bar action receptacle stop 47 lands against the golf club head embodiment 89 thereby providing clearance for loading or reloading the multi-cartridge bar action receptacle 54. With cartridge 42 selected held in positions by index detent spring ball 18 engaged into the discharge port 53 of the multi cartridge power strip bar action receptacle 54. Before firing golf club 14 the user rotates firing pin cam lever 30 clockwise pressing firing pin housing lever 30 firmly forward, which seats firing pin cam assembly 116 on the top of selected cartridge 42.

The distance adjuster indicator lever 70 is positioned on a ball travel scale 37 to the desired range a ball is expected to travel. The golf club handle 23 is placed in an upright position with the golf club head embodiment 89 adjacent to golf ball 27. The user places both hands on the golf club handle 23 in a conventional manner with the left thumb on thumb safety button 25 and the right thumb on firing trigger 26. Pulling upward on the safety button 25 and pressing firing button 26 fires golf club 89. The operational sequence of parts of golf club 14 after the actuation of safety slide 25 and firing trigger 26, which releases linkage rod 123 and trigger latching pawl 133 allowing firing pin spring 126 kinetic energy forcing firing pin hammer 122 to strike firing pin 118, thereby firing selected cartridge 42. High pressure gas generated from cartridge 42 flows into vortex generator chamber 64 and range control inlet 105, designed to burn and control a large portion of gun powder residue enhanced by means of a Platinum, Rhodium and Palladium coating on range control vortex generator core 94 and vortex generator chamber 64 before entering range control valve 105. The range control vent down chamber 92 depending on the position of range control valve body 93 setting on range control distant scale 37, high pressure will be dispersed in a ratio, thereby applying more-or-less pressure to striker/piston 85, more precisely to piston end 78 of striker/piston 85. The high-pressure gas "blow by" around the circumference clearance of striker/piston 85 and firing cylinder bore 65 is collected into the striker/piston blow-by propulsion silencer ring 81, which reduces the DB level as high-pressure gas is filtered through gas propulsion striker/piston blow-by propulsion silencer ring ports 83. When the high-pressure gas is applied to striker/piston blow-by propulsion silencer ring 81, thereby providing additional force to striker/piston 85 to drive golf ball 27 more distance. After striker/piston 85 has driven golf ball 27 in FIG. 1 and striker/piston 85 in FIG. 14 has extended to full travel, striker/piston 85 is restrained by urethane spring snubber 33 being deflected by striker/piston cam 79 and urethane spring is restrained by urethane spring 33 landing against urethane spring snubber 33 across housing clearance area 100. The reaction of golf club embodiment 89 resists the aft recoil motion by an anti-skid cleat plate 32 cleats 73-76 mounted on the bottom of embodiment golf club 89. urethane spring snubber 33, is secured to club head embodiment 89 by urethane spring retainer 16. Urethane spring snubber 33 extends horizontally through striker/piston guidance slot 80, thereby maintaining striker/piston 85 orientation during firing cycle. Range control valve input 105 vortex generator receives high pressure gas, thereby splitting the gas to cause a circular spinning vortex motion around armature shaft 94 forcing the gas to meet from opposite directions in the platinum, rhodium caladium coated chamber, before entering range control valve 91 inlet 105. The vortex gas flow pattern entering range control valve 91, which further shapes the vortex flow pattern after leaving range control valve 91 designed to maintain the optimum temperature, created by the vortex coating of platinum throughout the linear degrees of pressure change required for a given distance settings. Depending upon the position of vortex generator armature 94 the gas flow is proportionally dispersed with an exact ratio, into cylinder bore 65 on to the top of piston 78 and or into golf club head embodiment 89 silencing expansion area. This action allows high-pressure gas to expand thereby lowering the venting velocity of the high-pressure gas to an acceptable DB level. The maximum distance setting on ball travel distance scale 37 allows the maximum gas flow into cylinder 65 applying full pressure to the piston end 78 of striker/piston 85. The striker/piston 85 slides on striker/piston bearing surface 82 and striker/piston grooves 77 consisting of a hard anodized Teflon impregnated or ceramic coating, a given distance before exposing cylinder pre-exhaust ports 102,103 and exhaust ports 101,104.

As a first aspect of the present invention, the present disclosure includes a series of devices for a unique quiet reliable non-conventional golf club, capable of driving a golf ball varying distances from a static position, without swinging the golf club, (1) Device, for Striker/Piston Braking Action, occurs by providing a bending or flexing action allowed by the urethane braking material durometer to absorb the kinetic energy, induced into the striker/piston, dissipated during the flex/bending motion seating against a cam shaped bore, thereby stopping the striker/piston, (2) Device, for Multi-cartridge Power Strip Bar, provides a means to load the entire multi-cartridge power strip into a multi-cartridge power strip bar receptacle, to allow the advance of loads by a pressing motion, (3) Device, for Vortex Generator Chamber Plating, includes the existing vortex generator, whereby the present disclosure, adds a coating or plating of platinum, rhodium, caladium to the inside surface area of the vortex resonating chamber and vortex generator armature shaft, (4) Device, for Anti-skid Cleat Plate, is attached to the bottom of the club embodiment in order to prevent recoil induced as each cartridge is fired, (5) Device, for Floating Range Control Lever Mounting, is designed to float independently on the range control valve stem bushing mounted on vortex generator armature shaft, (6) Device for Blow-by Propulsion Silencer Ring, includes a striker/piston blow-by propulsion silencer ring to increase ball travel distance and DB reduction, (7) Device, for Firing Pin housing cam Hold Down Assembly, includes a firing pin housing cam hold down assembly, eliminates the prior art method, entirely, thereby lowering the cost to manufacture and improve assembly complications and to be more user friendly by including a rotatable lock down lever. The firing pin cam lock down assembly is designed to be inserted directly into the embodiment hozzle.

As a second aspect based on the first aspect, the die castable embodiment opening is designed to facilitate an oval shaped firing cylinder end facing containing an "O" ring providing a shaped cam housing for the urethane brake, which extends from embodiment enclosure perpendicular through, striker/piston elongated slot into the opposite side of embodiment enclosure bosses.

As a third aspect based on the first aspect, the golf club die casted embodiment, houses a shaped cam radius providing a means to deflect or bend the urethane material during the braking action movement, thereby absorbing the striker/piston kinetic energy.

As a fourth aspect based on the first aspect, the multi-cartridge power strip bar receptacle, housing the entire multi-cartridge power strip, eliminates the manual reloading hardship encountered in prior art.

As a fifth aspect based on the fourth aspect, allows a user to advance through loads of the multi-cartridge power strip, loaded into the multi-cartridge power strip bar receptacle, advanced to the next position or cartridge by pressing the multi-cartridge power strip bar receptacle end stop button inwards to the unfired cartridge.

As a sixth aspect based on the fifth aspect, the multi-cartridge power strip bar receptacle, provides for a proprietary keyed (by any means), multi-cartridge power strip, thereby assuring only the correct power level multi-cartridge power strip is used.

As a seventh aspect based on the fourth aspect, the moveable multi-cartridge power strip bar receptacle mates to the firing cylinder seat over a firing injection port, sealed and held in position by a spring ball seated into the discharge port of multi-cartridge power strip moveable bar receptacle.

As an eighth aspect based on the seventh aspect, the multi-cartridge power strip loads into the moveable multi-cartridge power strip bar receptacle for storing/consumption and provides a visual indication of the number of cartridges remaining to be consumed.

As a ninth aspect based on the first aspect, the present disclosure adds a coating or plating of platinum, rhodium, and caladium to an existing vortex generator chamber to provide a super burn rate to the gun powder residue, by raising the burning rate temperature, created by the coating, thereby solving a huge jamming problem.

As a tenth aspect based on the first aspect, the club embodiment comprises an anti-skid plate to absorb the recoil, which propels the embodiment in the opposite direction from the ball travel direction, thereby reducing the kinetic energy being applied to the ball, causing the ball to travel less distance without using the anti-skid plate.

As an eleventh aspect based on the first aspect, a range control vortex generator shaft extending through a firing cylinder stem hole sealed by an "O" ring, where the shaft provides a pressure gas deflector shaped to enhance the gas resonation in the vortex camber.

As a twelfth aspect based on the first aspect, failure occurs in any fixed range control lever mounting method using screws, which are prone to become loose caused by the huge shock wave. The present disclosure mounts the range control lever on a keyed floating ring/sleeve on the range control shaft, with the shaft end terminated in a tapered socket at the aft end of the embodiment bore.

As a thirteenth aspect based on the second aspect, the firing cylinder is held in place by two large screws projecting through the bottom of the embodiment into the aft end of firing cylinder in a vertical shear fashion and the forward end of firing cylinder is held in position by urethane spring extending into embodiment bosses.

As a fourteenth aspect based on the seventh aspect, a vortex generator chamber, located in the aft end of the firing cylinder, to provide a means to force burning gun powder gas into a vortex pattern, thereby sending unburned powder back into the burning in-coming powder, interfaces in the present disclosure with the movable multi-cartridge power strip bar receptacle discharge ports.

As a fifteenth aspect based on the first aspect, a propulsion silencer ring, encompassed in a groove ring protruding diameter of the striker/piston, whereby expanding gas bypassing the piston, enters the protruding ring groove.

As a sixteenth aspect based on the fifteenth aspect, a shaped protruding ring captures the blow by gas, to reverse the expanding gas flow in the opposite direction, whereby the expanding gas adds additional thrust to the striker/piston.

As a seventeenth aspect based on the sixteenth aspect, device integrated into the striker/piston to convert firing cylinder "blow by" gas pressure into kinetic energy and provide a means to reduce the DB level through a plurality of sized exit ports.

As an eighteenth aspect based on the first aspect, a selected cartridge is locked into the firing position by means of a rotary lever operated cam assembly, integrated into the golf club handle shaft end. The lever operated cam assembly unlocks the spent cartridge after firing, allowing the moveable multi-cartridge power strip bar receptacle to move to the next cartridge.

As a nineteenth aspect based on the eighteenth aspect, the lever operated hole down cam assembly is connected to the end of the golf club handle shaft and designed to be housed in the golf club embodiment hozzle.

As a twentieth aspect based on the eighteenth aspect, the rotary lever operated cam provides a housing for the firing pin and the firing pin return spring.

As a twenty-first aspect based on the sixth aspect, a multi-cartridge power strip, proprietary key shaped pattern in the top loading surface of the multi-cartridge power strip bar receptacle, designed to mate with or receive the notched end tabs or strip side cutouts in the multi-cartridge power strip, thereby allowing only the correct power level multi-cartridge power strip to engage into the multi-cartridge power strip bar receptacle.

Although the invention has been explained in relation to its preferred embodiment, it is to be understood that many other possible modifications and variations can be made without departing from the spirit and scope of the invention as hereinafter claimed.

What is claimed is:

1. A propellent-driven golf club to propel a ball without requiring a swinging action on the propellent-driven golf club, the propellent-driven golf club comprising:

a hollow shaft;

a handle attached to a top portion of the hollow shaft, wherein the handle comprises a triggering device configured for actuating a firing mechanism; and a golf club head assembly attached to a bottom portion of the hollow shaft, wherein the golf club head assembly comprises:

a bar receptacle comprising a plurality of receptacles configured to receive a plurality of cartridges;

the firing mechanism operationally coupled to the triggering device, wherein the firing mechanism is configured for firing a cartridge of the plurality of cartridges upon the actuating, wherein firing the cartridge generates gases;

a firing cylinder port configured to mate with at least a portion of the cartridge;

a vortex generator comprising a chamber, wherein the chamber comprises an ingress port and an egress port, wherein the ingress port is fluidly coupled to the firing cylinder port in order to receive the gases, wherein an interior profile of the chamber is deflected to enhance gas resonation, wherein the chamber further comprises a coating of platinum, rhodium, and caladium on an inside surface of the chamber;

a range control mechanism comprising a range control valve fluidly coupled to the egress port of the chamber, wherein the range control valve is configured to control a pressure of the gases at an outlet of the range control valve;

a firing cylinder bore fluidly coupled to the outlet of the range control valve; and a piston movably disposed in the firing cylinder bore, wherein the gases drive the piston, wherein a free end of the piston is configured to strike the ball.

2. The propellent-driven golf club of claim 1, wherein the piston comprises a propulsion silencing ring disposed around a periphery of the cylinder bore proximal to a club face of the propellent-driven golf club, wherein the propulsion silencing ring comprises a plurality of ports configured for filtering the gases received upon driving the piston, wherein the filtering of the gases reduces a sound decibel level associated with the firing of the cartridge.

3. The propellent-driven golf club of claim 1 further comprising an anti-skid mechanism disposed on a bottom surface of the golf club head assembly, wherein the anti-skid mechanism comprises a cleat plate comprising a plurality of cleats, wherein the plurality of cleats generates a frictional force between the bottom surface and an external ground surface, wherein the propellent-driven golf club rests on the external ground surface during the propelling of the ball, wherein the frictional force resists a recoil motion imparted to the propellent-driven golf club based on the firing of the cartridge.

4. The propellent-driven golf club of claim 1, wherein the cylinder bore comprises a piston bearing surface and a plurality of piston grooves disposed on an inner surface of the cylinder bore, wherein the piston slides on the piston bearing surface, wherein sliding of the piston corresponds to driving of the piston.

5. The propellent-driven golf club of claim 4 further comprising a hard anodized teflon coating impregnated on at least one of the piston, the piston bearing surface, and the plurality of piston grooves, wherein the hard anodized teflon coating reduces friction between the piston and the piston bearing surface for facilitating the sliding of the piston.

6. The propellent-driven golf club of claim 4 further comprising a ceramic coating on at least one of the piston, the piston bearing surface, and the plurality of piston grooves, wherein the ceramic coating reduces friction between the piston and the piston bearing surface for facilitating the sliding of the piston.

7. The propellent-driven golf club of claim 1, wherein the range control mechanism further comprises a range control lever and a ball travel scale, wherein the range control lever is disposed proximal to the ball travel scale, wherein the ball travel scale comprises a visual representation for displaying a plurality of distances, wherein the range control lever is positionable at a plurality of positions relative to the ball travel scale, wherein the plurality of positions corresponds to the plurality of distances for propelling the ball.

8. The propellent-driven golf club of claim 7, wherein the range control lever is mounted on a keyed floating sleeve disposed on a range control valve shaft comprised in the range control mechanism, wherein the keyed floating sleeve avoids loosening of the range control lever on the range control valve due to shock waves generated during the firing of the cartridge.

9. The propellent-driven golf club of claim 1, wherein the triggering device comprises a safety button and a firing button, wherein the safety button is operatively coupled with the firing button, wherein the safety button is configured to be transitioned between a pulled state and a relaxed state, wherein the firing button is configured to be transitioned between a depressed state and a raised state, wherein the actuating of the firing mechanism comprises transitioning the safety button to the pulled state followed by transitioning of the firing button to the depressed state.

10. The propellent-driven golf club of claim 1, wherein the golf club head assembly comprises a urethane spring snubber extending horizontally in a piston guidance slot comprised in the cylinder bore, wherein the urethane spring snubber comprises a receptacle for slidably receiving the piston, wherein the urethane spring snubber facilitates maintaining an orientation of the piston during firing of the cartridge for striking the ball, wherein the slidably receiving of the piston creates a frictional force between the urethane spring snubber and the piston, wherein the frictional force decelerates the piston upon striking the ball.

11. The propellent-driven golf club of claim 1, wherein the golf club head assembly further comprises a bar disposition mechanism, wherein the bar receptacle is disposed on the bar disposition mechanism, wherein the bar disposition mechanism is configured for moving the bar receptacle to a firing position based on a pressing action performed by a user to facilitate reloading of the propellent-driven golf club, wherein the reloading of the propellent-driven golf club comprises advancing of a second cartridge of the plurality of cartridges to the firing position upon firing of the cartridge, wherein the firing mechanism is configured for firing the second cartridge in the firing position.

12. A propellent-driven golf club to propel a ball without requiring a swinging action on the propellent-driven golf club, the propellent-driven golf club comprising:

a hollow shaft;

a handle attached to a top portion of the hollow shaft, wherein the handle comprises a triggering device configured for actuating a firing mechanism;

a golf club head assembly attached to a bottom portion of the hollow shaft, wherein the golf club head assembly comprises:

a bar receptacle comprising a plurality of receptacles configured to receive a plurality of cartridges;

the firing mechanism operationally coupled to the triggering device, wherein the firing mechanism is configured for firing a cartridge of the plurality of cartridges upon the actuating, wherein firing the cartridge generates gases;

a firing cylinder port configured to mate with at least a portion of the cartridge;

a vortex generator comprising a chamber, wherein the chamber comprises an ingress port and an egress port, wherein the ingress port is fluidly coupled to the firing cylinder port in order to receive the gases, wherein an interior profile of the chamber is deflected to enhance gas resonation;

a range control mechanism comprising a range control valve fluidly coupled to the egress port of the chamber, wherein the range control valve is configured to control a pressure of the gases at an outlet of the range control valve;

a firing cylinder bore fluidly coupled to the outlet of the range control valve; and a piston movably disposed in the firing cylinder bore, wherein the gases drive the piston, wherein a free end of the piston is configured to strike the ball; and an anti-skid mechanism disposed on a bottom surface of the golf club head assembly, wherein the anti-skid mechanism comprises a cleat plate comprising a plurality of cleats, wherein the plurality of cleats provides frictional force between the bottom surface and an external surface, wherein the propellent-driven golf club is disposed on the external surface, wherein the frictional force resists a recoil motion imparted to the propellent-driven golf club based on the firing of the cartridge.

13. The propellent-driven golf club of claim 12, wherein the chamber comprises a coating of platinum, rhodium, and caladium on an inside surface of the chamber.

14. The propellent-driven golf club of claim 12, wherein the piston comprises a propulsion silencing ring disposed around a periphery of the cylinder bore proximal to a club face of the propellent-driven golf club, wherein the propulsion silencing ring comprises a plurality of ports configured for filtering the gases received upon driving the piston, wherein the filtering of the gases reduces a sound decibel level associated with the firing of the cartridge.

15. The propellent-driven golf club of claim 12, wherein the range control mechanism further comprises a range control lever and a ball travel scale, wherein the range control lever is disposed proximal to the ball travel scale, wherein the ball travel scale comprises a visual representation for displaying a plurality of distances, wherein the range control lever is positionable at a plurality of positions relative to the ball travel scale, wherein the plurality of positions corresponds to the plurality of distances for propelling the ball.

16. The propellent-driven golf club of claim 12, wherein the golf club head assembly further comprises a bar disposition mechanism, wherein the bar receptacle is disposed on the bar disposition mechanism, wherein the bar disposition mechanism is configured for moving the bar receptacle to a firing position based on a pressing action performed by a user to facilitate reloading of the propellent-driven golf club, wherein the reloading of the propellent-driven golf club comprises advancing of a second cartridge of the plurality of cartridges to the firing position upon firing of the cartridge, wherein the firing mechanism is configured for firing the second cartridge in the firing position.

17. A propellent-driven golf club to propel a ball without requiring a swinging action on the propellent-driven golf club, the propellent-driven golf club comprising:

a hollow shaft;

a handle attached to a top portion of the hollow shaft, wherein the handle comprises a triggering device configured for actuating a firing mechanism;

a golf club head assembly attached to a bottom portion of the hollow shaft, wherein the golf club head assembly comprises:

a bar receptacle comprising a plurality of receptacles configured to receive a plurality of cartridges;

the firing mechanism operationally coupled to the triggering device, wherein the firing mechanism is configured for firing a cartridge of the plurality of cartridges upon the actuating, wherein firing the cartridge generates gases;

a firing cylinder port configured to mate with at least a portion of the cartridge;

a vortex generator comprising a chamber, wherein the chamber comprises an ingress port and an egress port, wherein the ingress port is fluidly coupled to the firing cylinder port in order to receive the gases, wherein an interior profile of the chamber is deflected to enhance gas resonation;

a range control mechanism comprising a range control valve fluidly coupled to the egress port of the chamber, wherein the range control valve is configured to control a pressure of the gases at an outlet of the range control valve;

a firing cylinder bore fluidly coupled to the outlet of the range control valve;

a piston movably disposed in the firing cylinder bore, wherein the gases drive the piston, wherein a free end of the piston is configured to strike the ball; and a bar disposition mechanism, wherein the bar receptacle is disposed on the bar disposition mechanism, wherein the bar disposition mechanism is configured for moving the bar receptacle to a firing position based on a pressing action performed by a user to facilitate reloading of the propellent-driven golf club, wherein the reloading of the propellent-driven golf club comprises advancing of a second cartridge of the plurality of cartridges to the firing position upon firing of the cartridge, wherein the firing mechanism is configured for firing the second cartridge in the firing position; and an anti-skid mechanism disposed on a bottom surface of the golf club head assembly, wherein the anti-skid mechanism comprises a cleat plate comprising a plurality of cleats, wherein the plurality of cleats provides frictional force between the bottom surface and an external surface, wherein the propellent-driven golf club is disposed on the external surface, wherein the frictional force resists a recoil motion imparted to the propellent-driven golf club based on the firing of the cartridge.

18. The propellent-driven golf club of claim 17, wherein the piston comprises a propulsion silencing ring disposed around a periphery of the cylinder bore proximal to a club face of the propellent-driven golf club, wherein the propulsion silencing ring comprises a plurality of ports configured for filtering the gases received upon driving the piston, wherein the filtering of the gases reduces a sound decibel level associated with the firing of the cartridge.

19. The propellent-driven golf club of claim 17, wherein the range control mechanism further comprises a range control lever and a ball travel scale, wherein the range control lever is disposed proximal to the ball travel scale, wherein the ball travel scale comprises a visual representation for displaying a plurality of distances, wherein the range control lever is positionable at a plurality of positions relative to the ball travel scale, wherein the plurality of positions corresponds to the plurality of distances for propelling the ball.

* * * * *